US012789063B2

(12) United States Patent
Sbytov

(10) Patent No.: US 12,789,063 B2
(45) Date of Patent: Nov. 10, 2026

(54) COMPETITIVE WATER BALLOON GAME

(71) Applicant: Anton Sbytov, San Diego, CA (US)

(72) Inventor: Anton Sbytov, San Diego, CA (US)

( * ) Notice: Subject to any disclaimer, the term of this patent is extended or adjusted under 35 U.S.C. 154(b) by 552 days.

(21) Appl. No.: 18/228,432

(22) Filed: Jul. 31, 2023

(65) Prior Publication Data

US 2024/0408467 A1 Dec. 12, 2024

Related U.S. Application Data

(60) Provisional application No. 63/472,571, filed on Jun. 12, 2023.

(51) Int. Cl.
*A63B 67/06* (2006.01)

(52) U.S. Cl.
CPC ..... *A63B 67/06* (2013.01)

(58) Field of Classification Search
CPC ..... A63F 2009/0273; A63B 65/12–122
See application file for complete search history.

(56) References Cited

U.S. PATENT DOCUMENTS 4,093,228 A 6/1978 Pierce
4,493,118 A * 1/1985 Braxton ..... E04H 1/1216 D25/16
4,629,188 A * 12/1986 Mahieu ..... A63B 63/00 473/454
4,702,480 A 10/1987 Popeski et al.
4,909,518 A * 3/1990 Erlandson ..... A63F 9/02 273/357
5,482,292 A 1/1996 Stone
5,848,793 A 12/1998 Celis
5,855,372 A 1/1999 Thiemann
6,264,201 B1 7/2001 Holsten et al.
6,296,252 B1 10/2001 Hubka
6,851,675 B1 2/2005 Jakubec et al.
8,702,104 B2 4/2014 Legary et al.
8,770,586 B2 7/2014 Kody et al.
9,901,837 B2 * 2/2018 Henslee ..... A63G 31/007
10,750,737 B2 * 8/2020 Noël ..... E04H 15/58

FOREIGN PATENT DOCUMENTS

KR 101987431 B1 6/2019

* cited by examiner

*Primary Examiner* — Brian O Peters
(74) *Attorney, Agent, or Firm* — Bycer & Marion, PLC; Matthew L. Bycer

(57) ABSTRACT

A competitive water dumping game may include a plurality of water balloon launching sites where two or more users stand within game enclosures and launch water balloons to fill the opponent's receptacle. The receptacle is fastened to the top of the game enclosure, above the player's head. When liquid fills the receptacle, depositing a specific weight of water to the bottommost section of the receptacle, the receptacle will overturn, dousing the player below. The receptacle may be coupled to a flag such that the tipping of the receptacle causes the flag to overturn indicating a scoring action. The player who overturns their opponent's receptacle, and flag, first is the winner of said water-dumping game.

20 Claims, 15 Drawing Sheets

COMPETITIVE WATER BALLOON GAME

CLAIM OF PRIORITY

The present application includes subject matter disclosed in and claims priority to a provisional application entitled "Competitive Water Balloon Game" filed Jun. 12, 2023 and assigned Ser. No. 63/472,571, describing an invention made by the present inventor, herein incorporated by reference.

BACKGROUND OF THE INVENTION

1. Field of the Invention

The present invention relates to a water-dumping game apparatus. More particularly, the present invention is directed to a water dumping game apparatus wherein a set of participants compete with one another to launch water balloons at their opponents.

2. Description of Related Prior Art

In warm climates and seasons water-themed activities, theme parks, and carnival games are particularly popular pastimes. Additionally, those participating in non-aquatic outdoor theme parks and carnivals may choose to supplement their activities with water-based games as a means of cooling off on warm days.

"Dunking" apparatuses that deposit participants into a large tank filled with water are particularly popular. Conventional water dunking apparatuses are comprised of a large water-filled tank, a platform structure capable of supporting a person located above the water tank, and a release mechanism that releases the platform into the water tank when prompted. Alternatively, the release mechanism may withdraw the platform such that the participant drops into the water tank due to gravity receptacle (or is removed to allow the participant to drop into the water tank via gravity). Generally, the release mechanism is mechanically connected to a target mechanism, such that when the target mechanism is struck, for example by a ball or bean bag thrown by a thrower at a set distance, the release mechanism is triggered such that the participant drops into the water tank.

Conventional water dunking apparatuses are often found at carnivals, fairs, and other outdoor events. These devices provide entertainment for both participants and spectators, and additionally offer a quick, easy, and enjoyable way for participants to cool off on a hot day. However, while conventional water dunking apparatuses are amusing and entertaining, they are heavy, bulky, and difficult to transport. Additionally, they are wasteful, as they require a substantial amount of water, and cannot be used at events lacking access to running water or to considerable amounts of stored water. Furthermore, conventional water dunking apparatuses may require electrical power which may limit the use of such apparatuses to areas with access to electrical power, pose a safety risk due to the dangerous combination of liquids and electric wires, and be costly to construct and maintain. Therefore, such electrically powered water dunking devices and are not feasible for small, outdoor gatherings or events.

The safety concerns associated with using water dunking apparatuses are not trivial. Such apparatuses pose significant risks including but not limited to drowning, injury, such as head or neck injury, upon collision with the bottom or walls of the tank, and infection if the water is not chemically treated, cleaned, or sanitized. The risk of infection is particularly formidable if the water in the tank is shared by multiple (consecutive) participants.

Alternative water-based games that mitigate the flaws associated with conventional water dunking games include games where participants are drenched by water balloons filled with water, rather than being dunked into a water tank. In some cases, such games involve multiple participants. Examples include game events where participants launch water balloons at one another from game enclosures. These enclosures may function to protect participants from direct water balloon hits. In such cases, the enclosures are constructed to include apertures, such that, the water balloons pop upon impact with the enclosures, and the water subsequently flows through the apertures.

While such games mitigate the risks of injury and infection posed by water dunking apparatuses, the apertured enclosure is bulky and difficult to transport. Additionally, by routing water from the popped balloons through apertures, participants do not get soaked as quickly as they would when dunked, thus reducing the fun and cooling effects of the traditional "dunking game".

Other water-based games include a game wherein a pivotable crossbeam suspends a prefilled receptacle over a participant's head. When a target is struck by a projectile, the receptacle subsequently overturns, dousing the participant with water. Another water balloon-based game is comprised of a basket containing a full water balloon and a puncturing member, with the basket being suspended over a participant's head. When players throw projectiles at a target, the target triggers the puncture member to move, puncturing a hole in the balloon and dousing the player below with the contents of the balloon.

While there are numerous variations of such water-drenching games, none of the aforementioned games enable multiple players to compete against each other with the goal of drenching their opponent first. Competitive water balloon games present a challenge due to water balloons' fast-moving, and fast-popping nature. If opponents throw balloons at each other, it is difficult to discern which balloon pops first, as the difference between the time the first and second balloons pop may be fractions of a second.

A water balloon-based game may present a "smart" apparatus wherein players each stand within their own enclosures. Each enclosure is comprised of digital balloon sensing devices that track scores based on how many balloons are in each enclosure, when balloons are fired from the enclosure, and when balloons strike their target. A scoreboard may record and display the scores, allowing players to compete with one another. Such a system relies on local battery power or remote-wired electrical power.

While such technologically advanced games promote competitive water-balloon sports, the enclosures are bulky, heavy, and difficult to transport. Additionally, such enclosures have the drawback of requiring electric power and therefore must be used in areas where electric power is available whether that be to power the "smart" apparatus or to charge the apparatus' battery when power is low. While they made be suitable for use at large theme parks, they are impractical for family gatherings, birthday parties, school carnivals, small fundraisers, and other low-key events where water-themed games are desired.

Additionally, the enclosure and all its prescribed sensors are not intended to be easily self-assembled by users. Furthermore, while digital sensors may be suitable methods for scorekeeping during a competition, aquatic play around electronic equipment invariably poses a risk of damage to the equipment, or worse, electric shock. While certain safety precautions may be taken to mitigate such risks, the prospect of water damage remains.

Currently known "smart" competitive water balloon games are also insufficient due to the method by which they deposit water onto participants' bodies. While such water games are intended to be safer alternatives to "dunking" games, the games only deposit water onto players through apertures in the enclosure. When one player launches a water balloon at another player the balloon pops on the enclosure, enabling the water to exit the balloon and flow through apertures in the enclosure to wet the opposing player. While users will get wet in such games, they will not enjoy the "soaking" sensation experienced during "dunking games".

The water balloon game apparatus described herein substantially departs from the conventional concepts and designs of currently known water balloon games, and in so doing provides an apparatus primarily developed to provide amusement to individuals by enabling a game wherein users can compete without relying on electronic or digital score-keeping. Moreover, the apparatus disclosed herein drenches players in water, rather than only wetting them with one water balloon at a time. Furthermore, the water used in each balloon is used to drench a single participant but is not reused from player to player. Additionally, the presently disclosed apparatus is simple to assemble and disassemble for easy transport and can be used by individuals or at small-scale events, as well as at large theme parks.

It is therefore a primary object of the present invention to provide a targeted water-dumping game apparatus.

It is a further object of the present invention to provide a method for playing a water dumping game.

These and other objects of the present invention will become apparent to those skilled in the art as the description thereof proceeds.

SUMMARY OF THE INVENTION

The present invention is directed to a competitive ballistic water dunking game system and method. Each player (or set of players) is given a shelter or enclosure. The enclosure may include a forward section and a back section, a top section and two side sections. The bottom is preferably open, and mounts onto the ground surface below for the player and enclosure to rest there. The first forward panel may have a launching apparatus that allow the player within to cause a fluid-filled projectile to travel out of the enclosure to the opponents enclosure or target of an opponent's shelter. A target is preferably set with the receptable so that as the receptable is filled, the weight balance of the receptacle changes relative to a transversal bar coupled to the enclosure and causes the receptacle to overturn (emptying contents/liquid on the user) and drop the flag. The receptacle may be mounted to at least one lateral bar and the receptacle is preferably placed above a participant location within said shelter. The target may include a flat panel fixedly coupled to the receptacle such that both target and receptacle rotate in unison along a rotational axis of the lateral bar. The flat panel may be adjustable in height and/or width, changing location and two-dimensional size of target. Opponent may aim for target and use as a backboard for filling the receptacle.

The front may include a top include portion towards or over the user. The first forward panel on the front wall may be angled with a top section set back and over the participant location at approximately twenty to sixty degrees from a vertical. The front wall may extend vertically below the first forward panel. A side wall may be coupled to the front wall via hinges having vertical axes, and a back wall hingedly coupled to said side wall, so that the enclosure may be collapsed into a flat system for transport. Wings may be attached to the sides, top, and/or front, to prevent from inadvertent splashes from missed shots, and may also cover (or be set under) portions of the front wall to prevent direct or partially indirect shots from splashing user through the wall.

The launching apparatus may be coupled to the front wall and may include an elastic launcher with a platform or cup connected to a pair of cords that may be set around an optionally open aperture to allow launching through the aperture. The aperture is preferably covered with a plane, preferably a clear hinged protective panel sized to cover and obstruct the aperture when in a closed position.

The invention may also be played with a water launching and sheltering gaming apparatus wherein players alternatively or concurrently launch water containing projectiles towards one another's shelter targets with a goal of filling a receptacle over the opposing player with spilled water from the projectiles to cause the receptacle to lose balance and overturn contents on to the opposing player. The structure may include a first forward panel positioned between a first player and a second player. The forward panels may include a reclosable aperture providing a shield from any projectiles launched from a second structure (the second structure having a matching system of enclosure. A target may be set above both players' heads, behind or above the forward panel. The target is preferably attached to a receptacle that may be filled with the liquid contents of the projectiles sent between one another. Each enclosure may include a launching apparatus, mounted to the frame, adapted to launch a fluid-containing projectile towards the opponent. Each forward panel may include a first shield to allow for independent manipulation of the shield to an open and closed position, open for launch, and closed for receiving opponent shots, with the aim to be at the target above to disperse fluid from the broken projectile into the receptable and cause it to overturn when a predetermined weight of fluid is set in the receptacle. When the receptable overturns, the flag may drop indicating to the distance opponent that the score has been made, or game won. The receptacle may be positioned under the target and above the player's position of each enclosure. The receptacle(s) may be rotatably mounted to a first bar coupled to the enclosure, forming a first rotation axis, wherein the receptacle adapted to invert when a predetermined weight of fluid is deposited therein. The targets may be adjustable in shape and position, for instance to give a handicap to a player, one target may be enlarged or lowered to allow for easier targeting by opponent. Projectiles may bounce off target, or be ruptured thereupon (a stiff panel), emptying contents in or near the receptacle to cause it to overturn when filled and douse player below within the enclosure. The target is preferably fixedly mounted to the receptacle such that rotation and inversion of the receptacle pulls and rotates the target to a down position.

One may practice the invention via a method of game play by preparing and playing a competitive water balloon launching game, wherein the competitors are positioned behind shielding structures, to allow for alternative launching of projectiles at a target positioned above the opposing player. A first player is positioned behind a first forward panel. A launching apparatus is coupled to the forward panel the first player to launch a fluid-filled projectile forward through a first window in the first forward panel at a target opponent. The second player may be positioned behind a second forward panel such that the first and second forward panels are situated between the first and second players, and the players are positioned distance one another. Three or more systems may be arranged likewise, with each player behind their own panel with their own launching system. Each player may selectively open their window and take turns launching a projectile through the window towards a second target that may be positioned above a receptacle over the second player. The receptable may be positioned slightly rearward of the player so that contents spilling land on player's position. The receptable is filled with fluid from the launched projectile (the fluid to fill a volume on one side of the receptacle causing an unbalancing of the receptacle about an axis of rotation) causing the receptable to overturn and dump fluid contents from the receptacle onto the opposing player. As the receptable overturns, the target or flag may move to remotely indicate a score. Between turns, the player may close their front panel window to block form direct assault of projectiles and splashes.

The water balloon game apparatus described herein substantially departs from the conventional concepts and designs of currently known water balloon games by providing an apparatus that enables a competitive game wherein users can compete without relying on electronic or digital scorekeeping, users are soaked in water, and users can easily assemble, disassemble, and transport the invention without the use of professional assistance. The water balloon game apparatus described herein is comprised of a shelter, a receptacle, and an alert system. The shelter may be comprised of at least one frame, but in some embodiments is comprised of a front frame and a plurality of side frames. In other embodiments, the shelter also is comprised of a back frame. The shelter may be coupled to a top cover. Participants may launch balloons or other projectiles from an aperture in the shelter, or in the shelter top cover. The aperture may be sheathed by a removable panel such that balloons and other projectiles cannot enter the shelter through the aperture. Participants may remove the protective panel in preparation to launch balloons or other projectiles out through the aperture. In some embodiments, the protective panel is coupled to a lifting cord such that participants can easily lift the panel from within the shelter. The protective panel may be coupled to a launching mechanism such that when the mechanism is prepared for a launch the protective panel automatically retracts. The protective panel may be fixed to the aperture with one or more hinges. When projectiles are not being cast from the aperture, the protective panel may axiomatically return to sheath the aperture. The aperture may be set in the shelter frame or in the top cover. A receptacle hangs over participants' heads. When the receptacle fills with the material contained within the balloons or other projectiles, the receptacle upends over participants' heads. The receptacle may be coupled to the shelter. The receptacle may be coupled to a shaft or rotating rod. In some embodiments, the receptacle overturns as a result of the rotating rod pivoting around an axis. The receptacle may be coupled to the shelter via the shaft or rotating rod. The receptacle may have an uneven or sloped bottom, such that an uneven distribution of weight and a shifted gravitational force cause the receptacle to overturn when said receptacle is filled with material. To prevent the receptacle from overturning prematurely, portions of the receptacle may be filled with weight(s). The receptacle may also be filled with space fillers that provoke the material deposited by the balloons or other projectiles to settle in the portions of the receptacle that will trigger it to overturn. A flag or other alert system may notify participants of the receptacle's filling with material, or of the receptacle tipping. In some embodiments, the flag may be coupled to the receptacle. In other embodiments, the flag may be coupled to a shaft or rotating rod. The flag may be adjustable in length and/or width. The flag is stiff, such that it may serve as a rebound board.

When using the apparatus for competitive water dumping games, users stand within shelters and cast water balloons or other projectiles from therein. Each player aims their water balloon(s) at the opponent's receptacle, which may be suspended, or otherwise hanging above the opponent's head. The receptacle may be fastened over or within the top of the game enclosure, above the player's head. When a number of balloons or other projectiles enter the receptacle, depositing a specific weight of water to the receptacle, the receptacle will overturn, dousing the player in water. The receptacle is coupled to a flag such that the tipping of the receptacle causes the flag to overturn. The player who overturns their opponent's receptacle first is the winner of said water-dumping game.

BRIEF DESCRIPTION OF THE DRAWINGS

The present invention will be described with greater specificity and clarity with reference to the following drawings, in which.

DETAILED DESCRIPTION OF THE PREFERRED EMBODIMENTS

Figure 1:
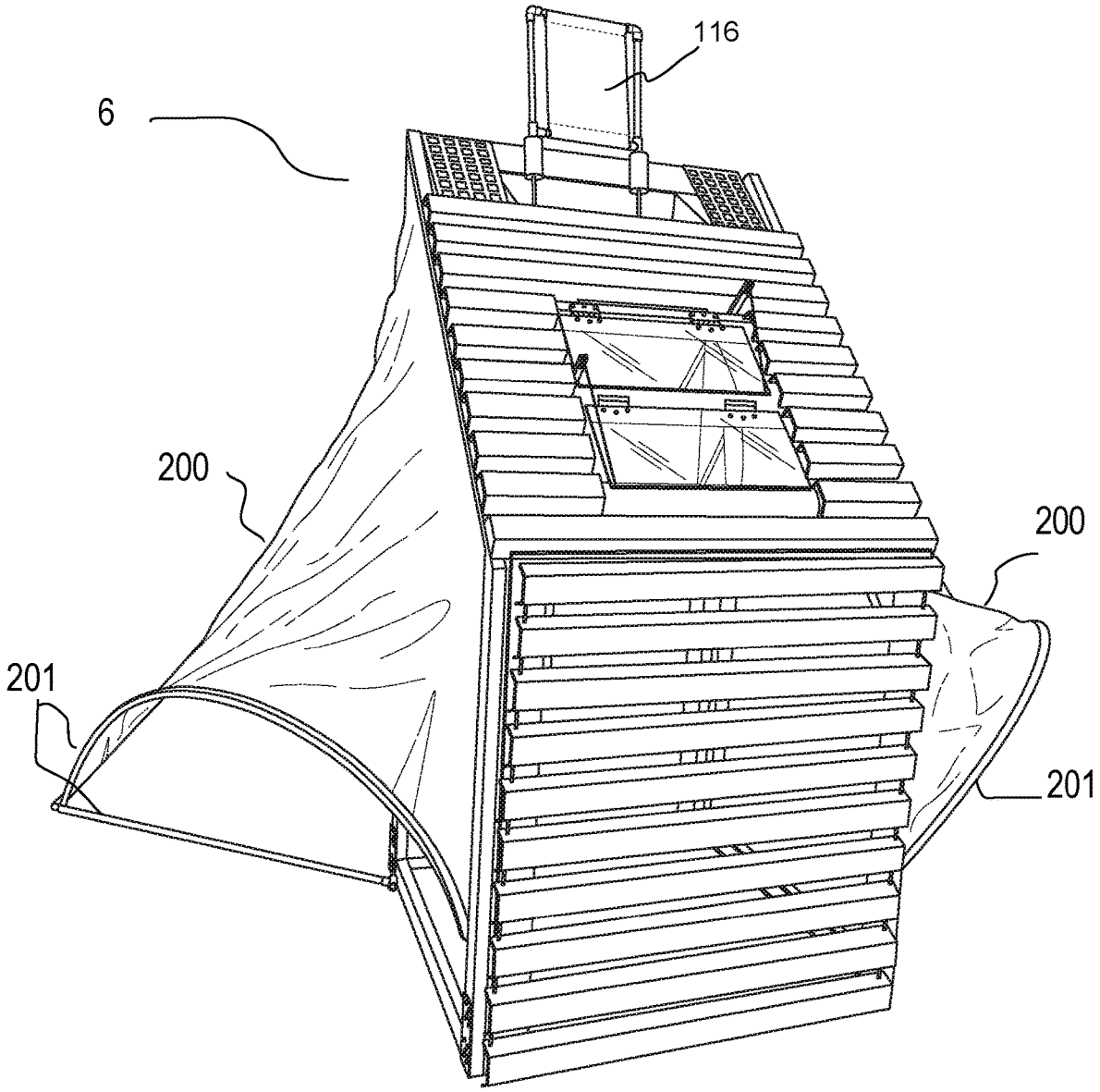
FIG. 1 is a front perspective view of an embodiment of the game system with wings.

As shown in FIG. 1, the game system enclosure 6 may be useful for storing a participant thereunder/therewithin, and may also include wings 200 made of a water resistant, or water proofing sheet, e.g., polyvinyl, nylon, cloth, or otherwise useful for shielding the participant set therein for splashing when the target is not hit, but projectile is exploded on the frame or ground. One or more rigid/flexible rods 201 may be affixed to ends or edges of wings 200 to provide shape to wings 200.

General Game Play

A competitive water balloon game employs game enclosure 6 attached to a means for catching and dumping water balloons, herein referred to as receptacle 10, such that when balloons or other projectiles enter receptacle 10, they pop therewithin filling receptacle 10 with their contents. When receptacle 10 fills with a particular mass of material, is may overturn, drenching the participant below in the material.

Figure 2:
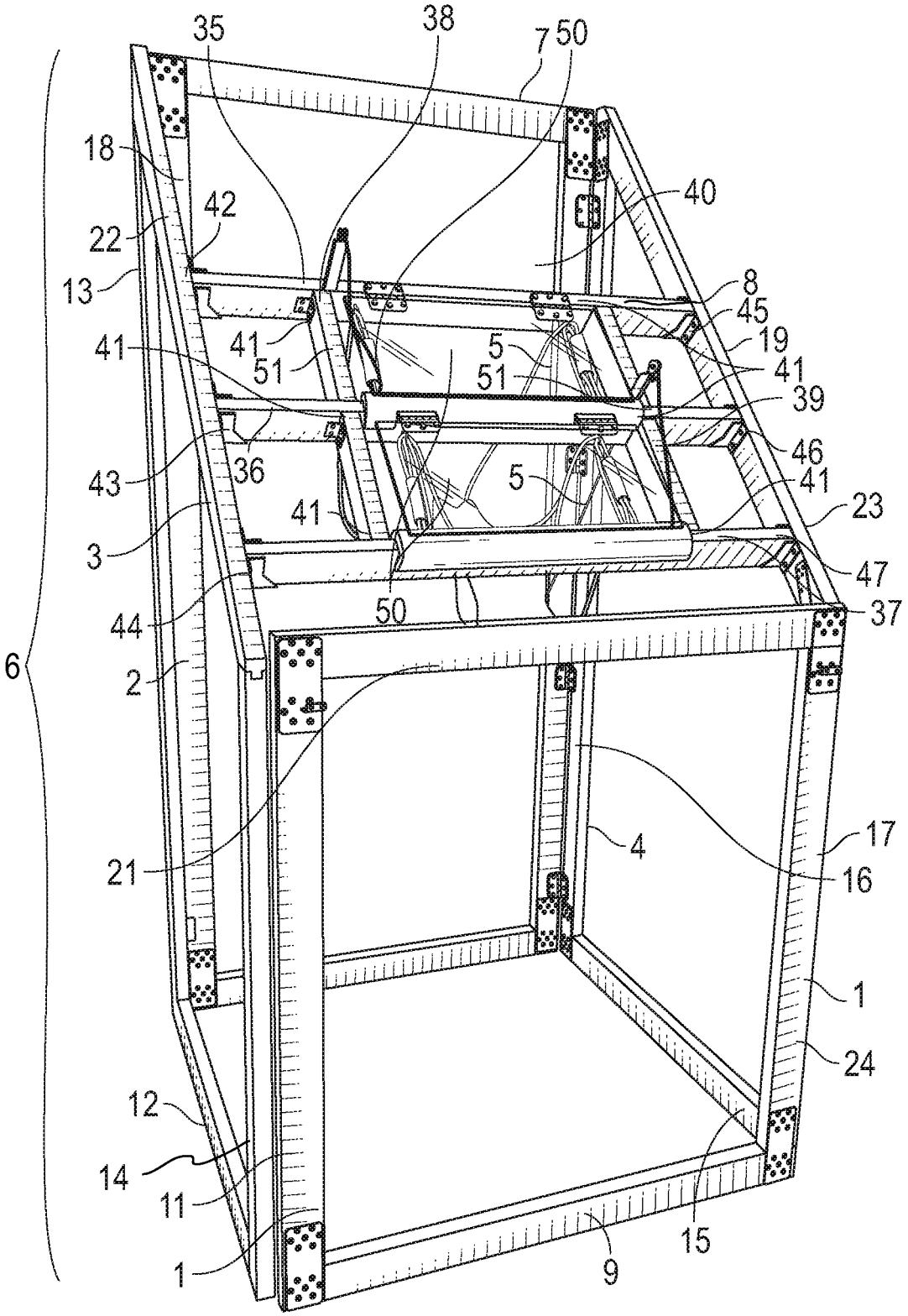
FIG. 2 is a front perspective view of an embodiment of the game enclosure frame.

In one embodiment, as seen in FIG. 2, game enclosure 6 may be structured with front frame 1, back frame 2, left sidewall frame 3, and right sidewall frame 4. In such embodiments, participants may be situated within the walls and be wholly surrounded by enclosure 6. In an alternative embodiment, players may be sheltered behind enclosure 6 constructed of only one wall. In another embodiment, game enclosure 6 may be constructed from two walls. In a further alternative embodiments game enclosure 6 may be constructed from three walls.

During competitive play, it is contemplated that each player may stand within their own shelter, herein referred to as game enclosure 6. Thus, a plurality of enclosures 6 may be necessary for competitive game play. While it is likely that two enclosures 6 with one player housed in each enclosure 6 is a possible arrangement, a number of alternative arrangements allow for operative competitive play. For example, in an alternative embodiment, each enclosure 6 may house multiple participants. Additionally, as an alternative, three or more enclosures 6, housing one or more players, may be used with enclosures 6 set up at points of a polygonal arrangement facing the center. In a further alternative, a multitude of enclosures 6 may be arrayed in two lines facing one another, or displayed along an obstacle course, whereby a mobile player (outside of any enclosure 6) is required to attack enclosure 6 while avoiding their own splash attacks from the player in the enclosures 6.

During game play, participants may launch water balloons, other liquid-filled devices, such as magnetic self-sealing reusable water balloons, or other projectiles out of enclosure 6 through aperture 5. In some embodiments, aperture 5 may be an openable and closable window. Aperture 5 may be closed when the player is not launching, to provide for safety such that errant launched water balloons cannot directly enter the enclosure through aperture 5 and strike the player.

Upon launch, balloons, alternative liquid filled devices, or other projectiles may be aimed at an opponent's receptacle 10. In some embodiment, it is preferable that receptacle 10 be fastened to game enclosure 6. In some embodiments receptacle 10 may be fastened at the top of enclosure 6. In other embodiments receptacle 10 may be fastened above enclosure 6. Alternatively, receptacle 10 may be fasted within enclosure 6. It is preferable that receptacle 10 be fastened at a height above participants heads such that that contents of receptacle 10 will be dumped upon a participant when receptacle 10 overturns.

After one or more successfully aimed balloons or other projectiles land within receptacle 10, the bottommost section of receptacle 10, receptacle deep bottom 77, may fill with the contents of the balloons or other projectile, causing receptacle 10 to overturn, and to release its contents on the participant, stationed within the enclosure, below. Thus, the player in the enclosure below is drenched with the contents of the balloons or other projectile. In some embodiments, the balloons or projectiles may be filled with water. Alternatively, the balloons or projectiles may be filled with any liquid, gel, or amorphous material. In another alternative embodiments the balloons or projectiles may be filled with sand. In another alternative embodiments snowballs can be used as projectiles.

Figure 13:
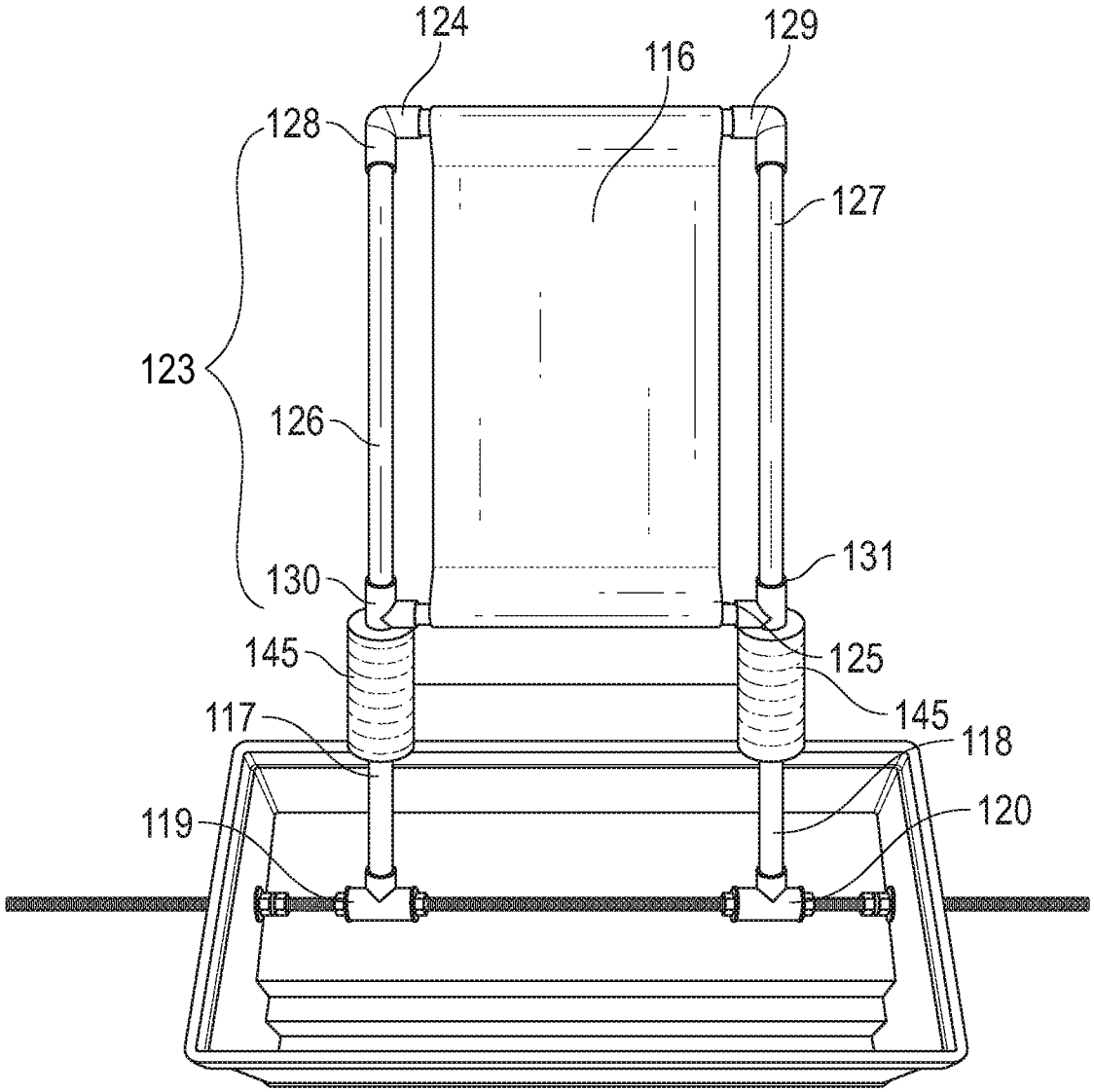
FIG. 13 is an isolated frontal view of an example of a flag attached to receptacle with mounting bar set therethrough.

As seen in FIG. 13, flag 116 may be used to alert participants to the tipping of the receptacle 10 (i.e., victory), such that a winner of the quick-paced game can easily be determined. Alternatively, flag 116 may notify participants that a player is disqualified from further participation during the game round. In some embodiments, the winner of the game may be the player who overturns their opponent's receptacle first. Alternatively, in a game with three or more enclosures 6 the last player to be doused may be the victor. The game round can be restarted when one, or all of receptacle(s) 10 empty. Alternatively, the game round may restart when one or all of receptacles 10 are set upright.

Turning now to the drawings, in which similar reference characters denote similar elements throughout the several views, FIGS. 1 and 2 illustrate an embodiment of enclosure 6. While enclosure 6 may be any receptacle 10 supporting structure from wherein, or behind which, participants may launch projectiles, in one embodiment enclosure 6 may be constructed from front frame 1, back frame 2, left side frame,3, and right-side frame 4. Enclosure top 8 may be set upon enclosure 6, but need not be permanently attached to enclosure 6. Therefore, front frame 1, back frame 2, left side frame 3, and right-side frame 4, may be surrounded by studs 7 on three sides, with an open fourth top side wherein enclosure top 8 may be set. Alternatively, front frame 1, back frame 2, left side frame 3, and right-side frame 4 may be constructed from studs 7 on four sides, such that enclosure top 8 connects to left side frame top 18 and right-side frame top 19. In some embodiments, front frame 1 and back frame 2 are each constructed from at least one, but preferably at least two sideways studs such as level stud 9 and level stud 21, coupled to at least two upright studs, such as right upright stud 24 and left upright stud 11. The level studs, such as level stud 9 and level stud 21 may lie parallel to the ground, or alternatively they may be inclined at various angles. In some embodiments, upright stud 24 and upright stud 11 are vertical such that they intersect level stud 9 and level stud 21 at right angles. Alternatively, upright stud 24 and upright stud 11 may be angled such that the angles between level stud 9 and level stud 21 and the upright studs are acute or obtuse. In some embodiments, one upright stud, such as but not limited to upright stud 11 may be vertical and intersect level stud 9 and level stud 21 at a right angle, while a second upright stud, such as but not limited to upright stud 11 may be angled and intersect level stud 9 and level stud 21 at acute or obtuse angles. The studs may be fastened, one to the other using nails, screws, or other appropriate fastening means.

In some embodiments, left side frame 3 and right-side frame 4 may be constructed from one, but preferably at least two sideways studs, such as left side frame bottom stud 12 and left side frame top stud 22. The sideways studs may be coupled to one, but preferably at least two upright studs such as left side frame back stud 13 and left side frame front stud 14. In some embodiments the bottom studs, such as left side frame bottom stud 12 may lie horizontally, while the top studs, such as left side frame top stud 22 may be angled, preferably at a range from zero to sixty degrees. It is worth noting that enclosures 6 constructed from side frame top studs oriented at angles outside of the preferred range are likewise suitable for game play. It is worth noting that in embodiments where top studs, such as left side frame top stud 22 are angled, the upright studs such as left side frame back stud 13 and left side frame front stud 14 may not be congruent in length, such that the length of each upright stud accommodates the change in the sideways stud angle.

In some embodiments, the studs forming front frame 1 and back frame 2 preferably have a height extending the full length of the enclosure, which may in some embodiments eight feet six inches. Front frame 1 may be approximately half the length of back frame 2. In some embodiments front frame 1 may span a length of four feet four inches. Left side frames 3 and right-side frame 4 may serve to connect elements back frame 2 and the front frame 1. Left side frame 3 may be constructed from left side frame bottom stud 12, left side frame back stud 13, and left side frame front stud 14. Accordingly, right side frame 4 may be constructed from right side frame bottom stud 15, right side frame back stud 16, and right-side frame front stud 17. In some embodiments, to seamlessly connect front frame 1 to back frame 2, left side frame back stud 13 and right-side frame back stud 16 may be equivalent in height to back frame 2. Similarly left side frame front stud 14 and right-side frame front stud 17 may be equivalent in height to front frame 1. Front frame 1 and back frame two may connect by angled sideways studs such as left side frame top stud 22 and right-side frame top stud 23. In some embodiments, left frame stud 22 and right frame stud 23 are congruent in length. In some embodiments, the overall arrangement of left side frame 3 and right-side frame 4 may be tapered, or trapezoidal in shape.

Figure 3:
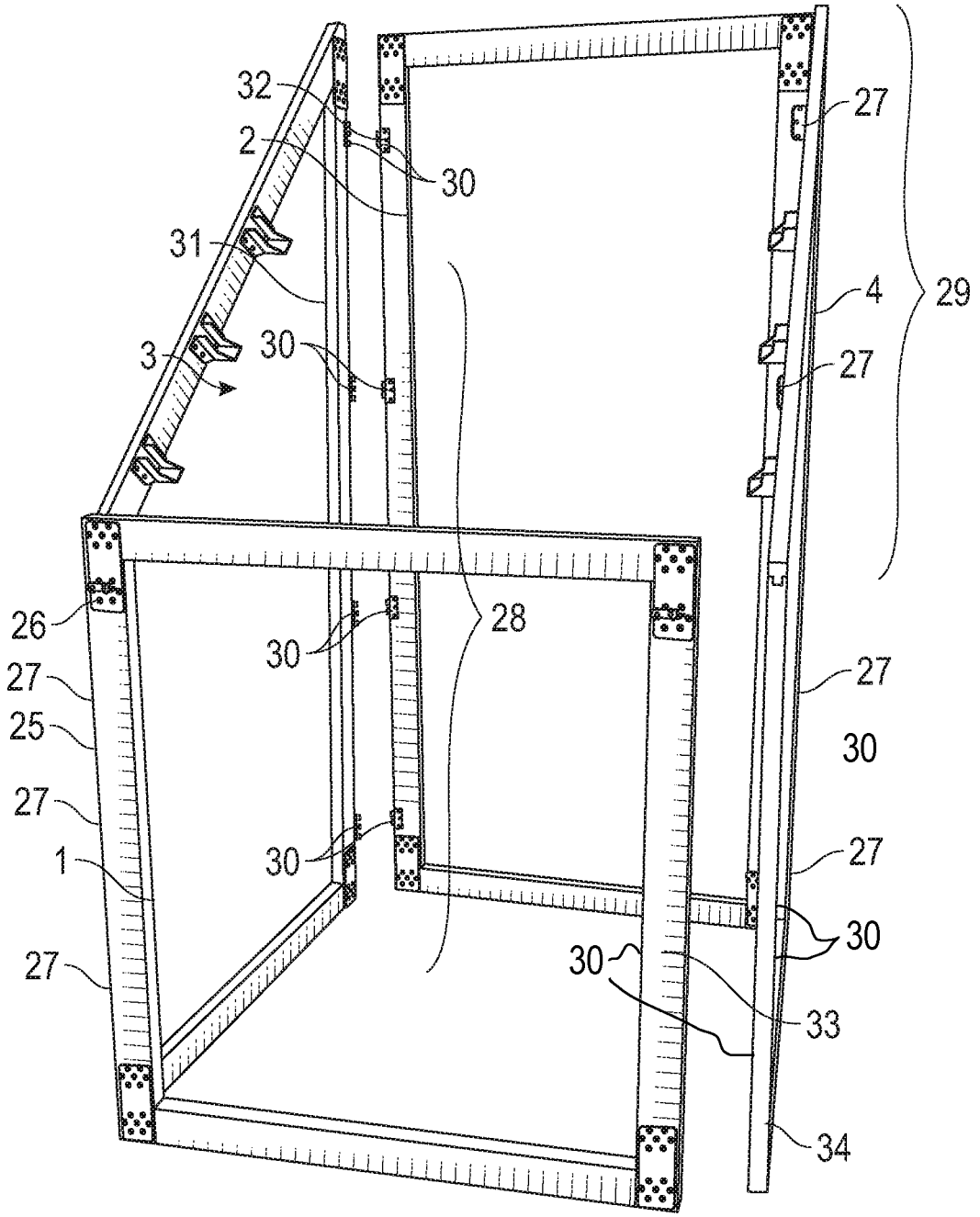
FIG. 3 is a partially exploded view of an embodiment of the foldable game enclosure frame.

As seen in FIG. 3, in some embodiments, front frame 1 and back frame 2 may be, but are not necessarily, each permanently connect to a side frame, such that to assemble enclosure 6, coupled frame 28 and coupled frame 29 are attached one to the other. For example, front frame 1 may be coupled to left side frame 3, forming coupled frame 28. The two frames are preferably coupled in such a manner that the two attached frames may fold together as a single planar unit. As seen in FIG. 2, front frame 1 and left side frame 3 may be attached, one to the other, by attaching front frame edge 25 to left side frame edge 26 using one or more door hinges 27. Door hinges 27 preferably pivot to allow for smooth movement and easy folding. In some embodiments, door hinges 27 provide a pivot point for front frame 1 and left side frame 3 to rotate, allowing them to swing inward or outward. Similarly, in some embodiments, back frame 2 and right-side frame 4 are also permanently connected by door hinges 27 in the same manner, forming coupled frame 29. Door hinges 27 may ensure that coupled frame 28 and coupled frame 29 remain securely fastened while allowing for easy folding and unfolding. In an alternative embodiment, front frame 1 may be attached to right side frame 4, while the back frame 2 may be attached to the left side frame 3. In such alternative embodiments, all other mechanisms and components of the enclosure design discussed above and below remain the same.

Coupled frame 28 may be joined to coupled frame 29 with door hinge leaves 30 and removable pins (not pictured), constructing enclosure 6. To join coupled frame 28 to coupled frame 29 unattached edge 31, unattached edge 32, unattached edge 33, and unattached edge 34 are each fastened with door hinge leaves 30. Preferably door hinge leaves 30 are fastened to unattached edge 31 in such a manner that they will interlock with door hinge leaves 30 on unattached edge 32. Similarly, it is preferable that door hinge leaves 30 on unattached edge 33 interlock with door hinge leaves 30 on unattached edge 34. In some embodiments, once hinge leaves 30 are appropriately interlocked, removable pins (not pictured) may be inserted into hinge leaves 30, Removable pins preferably slide in and out of hinge leaves 30 with minimal effort, allowing for effortless assembly and disassembly.

While the use of door hinges 30 and removable pins (not pictured) may provide a secure, durable, and sturdy connection between the walls when assembled, to transport or store enclosure 6, removable pins (not pictured) may be removed, such that coupled frame 28 and coupled frame 29 may be folded into a flat configuration.

In an alternative embodiment, coupled frame 29 may be permanently attached to coupled frame 28 with pivotable hinges such that the entire enclosure 6 may fold flat, without first needing to be disassembled.

Enclosure 6 may be fashioned from wood, plastic, other such lightweight, durable, and sturdy materials, or any other suitable material. In some embodiments, left side frame 3 and right-side frame 4 may be sheathed in a protective material, such that water balloons or other projectiles cannot penetrate enclosure 6 through left side frame 3 or right-side frame 4. In some embodiments, the protective sheathing may be manufactured from mesh or fabric. Alternatively, vertical or horizontal panels, spanning the length or width of enclosure 6 may be fastened to the perimeter forming studs 7. Preferably, empty spaces between the panels will not exceed the diameter of the water balloons or other projectiles, such that the balloons or other projectiles cannot penetrate enclosure 6 through spaces between the panels. Protective sheathing, panels, or any other protective material may also enclose front frame 1, and sections of enclosure top 8. In some embodiments, a lattice shield may function as protective sheathing for left side enclosure frame 3, right side enclosure frame 4, enclosure front 1, and/or portions of enclosure top 8. The lattice shield may be constructed from a series of evenly spaced vertical and horizontal strips that intersect to form a grid-like pattern. The strips may intersect at right angles, creating a crisscross pattern that allows for the passage of airflow and light, while still protecting participants from stray water balloons. Alternatively, the strips may intersect at acute, obtuse, or various combinations of right, acute, and obtuse angles. The strips may be formed from any suitable material such as wood, metal, fabric, or plastic.

After assembling the enclosure walls, enclosure top 8 may be installed at the top of enclosure 6. Although any protective covering is satisfactory, in an embodiment, as seen in FIG. 2, enclosure top 8 may constructed from sideways crossbeam 35, sideways crossbeam 36 and sideways crossbeam 37 traversed by at least two upright crossbeams such as upright crossbeam 38 and upright crossbeam 39. The sideways and upright crossbeams may intersect one another at acute, obtuse, or right angles. The intersecting crossbeams preferably form a protective structure, enclosure top 8, that covers a portion of the top of enclosure 6, leaving open an uncovered space 40 of at least sufficient size to allow for the entry of balloons or other projectiles into receptacle 10.

In some embodiments of enclosure top 8, sideways crossbeam 35, sideways crossbeam 36 and sideways crossbeam 37 may run lateral to one another. Sideways crossbeam 35, sideways crossbeam 36, and sideways crossbeam 37 may run lateral to level stud 21. Alternatively sideways crossbeam 35, sideways crossbeam 36, and sideways crossbeam 37 may be angled. In some embodiments of enclosure top 8, upright crossbeam 38 and upright crossbeam 39 may traverse sideways crossbeam 35, sideways crossbeam 36, and sideways crossbeam 37 perpendicularly. In some embodiments of enclosure top eye, upright crossbeam 38 and upright crossbeam 39 may traverse sideways crossbeam 35, sideways crossbeam 36, and sideways crossbeam 37 at acute or obtuse angles. Alternatively, upright crossbeam 38 and upright crossbeam 39 may traverse sideways crossbeam 35, sideways crossbeam 36, and sideways crossbeam 37 at congruent or incongruent angles. In some embodiments the upright and sideways crossbeams form a grid like pattern. In some embodiments, the distance between sideways crossbeam 35 and sideways crossbeam 36 equals the distance between sideways crossbeam 36 and sideways crossbeam 37. Alternative arrangements are also suitable. It is preferable that the distance between sideways crossbeam 35, sideways crossbeam 36, and sideways crossbeam 37 be slightly larger than a full water balloon or other projectile, such that a water balloon or other projectile could pass through the space between the crossbeams.

In some embodiments upright crossbeam 38 may be, but is not necessarily set, nine and a half inches from left side frame top stud 22, and upright crossbeam 39 may be, but is not necessarily, set nine and a half inches from right side frame top stud 23. In such embodiments, the distance between upright crossbeam 38 and upright crossbeam 39 may span approximately twenty-five and a half inches. Alternatively, in some embodiments, upright crossbeam 38 may traverse sideways crossbeam 35, sideways crossbeam 36, and sideways crossbeam 37 approximately a quarter distance. between left side frame top stud 22 and right-side frame top stud 23. In some embodiments, upright crossbeam 39 may traverse sideways crossbeam 35, sideways crossbeam 36, and sideways crossbeam 37 at approximately a three-quarter distance. between left side frame top stud 22 and right-side frame top stud 23. In some embodiments, aperture(s) 5 (which may be but is/are not necessarily rectangular in shape), large enough in length and width to fit the diameter of a water balloon or other projectile is/are formed between the crossbeams. In some embodiments, upright crossbeam 38, sideways crossbeam 35, upright crossbeam 39, and sideways crossbeam 36 form the perimeter of aperture 5. Upright crossbeam 38, sideways crossbeam 36, upright crossbeam 39, and sideways crossbeam 37 may also form the perimeter of a second aperture 5.

For added security, in some embodiments sockets 51 may be, but are not necessarily, hollowed out from either the upright or sideways crossbeams at intersection points 41, such that sideways crossbeam 35, sideways crossbeam 36, and sideways crossbeam 37 may be nestled within upright crossbeam 38 and upright crossbeam 39. Alternatively, but not necessarily, upright crossbeam 38 and upright crossbeam 39 may be nestled within sideways crossbeam 35, sideways crossbeam 36, and sideways crossbeam 37. Sockets 51 may be indentations hollowed of sideways crossbeam 35, sideways crossbeam 36, and sideways crossbeam 37 having dimensions that correspond to the size and shape of upright crossbeam 38 and upright crossbeam 39. Alternatively, the sockets may be indentations hollowed of upright crossbeam 38 and upright crossbeam 39 having dimensions that correspond to the size and shape of sideways crossbeam 35, sideways crossbeam 36, and sideways crossbeam 37. In some embodiments, sockets 51 are only hollowed out of sideways crossbeam 36 such that upright crossbeam 38 and upright crossbeam 39 are only nestled within sideways crossbeam 36. In such embodiments, upright crossbeam 38 and upright crossbeam 39 may be fastened to sideways crossbeam 35 and sideways crossbeam 37 with other fastening means known to those skilled in the art. In other embodiments sockets may be used at some intersection points 41, while other fastening means known to those skilled in the art may be employed at other intersection points 41.

Sideways crossbeam 35, sideways crossbeam 36, and sideways crossbeam 37 may alternatively or additionally be fastened to upright crossbeam 38 and upright crossbeam 39 at intersection points 41 via standard fastening means including but not limited to glue, nails, screws, and bolts. Enclosure top 8 may then be set upon enclosure 6. In some embodiments enclosure top 8 may be placed upon a series of brackets. Top left bracket 42, center left bracket 43, and bottom left bracket 44 may be fastened to left side frame top stud 22. Top right bracket 45, center right bracket 46, and bottom right bracket 47 may be fastened to top right frame stud 23. Enclosure top 8 may be rest upon the aforementioned brackets such that sideways crossbeam 35 rests between top left bracket 42 and top right bracket 45, sideways crossbeam 36 rests between center left bracket 43 and center right bracket 46, and sideways crossbeam 37 rests upon bottom left bracket 44 and bottom right bracket 47. Alternatively, enclosure top 8 may extend over enclosure 6, such that enclosure top 8 rests, or is fastened directly to left side frame top stud 22, top right frame stud 23, and or level stud 21. Any suitable means for coupling enclosure top 8 to enclosure 6 may be proper.

In some embodiments, as seen in FIG. 2 and FIG. 3, top left bracket 42, center left bracket 43, and bottom left bracket 44, top right bracket 45, center right bracket 46, and bottom right bracket 47 may be fastened along left side frame top stud 22 and right-side frame top stud 23 such that when enclosure top 8 is set upon the series of brackets uncovered space 40 remains exposed such that water balloons or other projectiles may enter receptacle 10 through uncovered space 40. Regardless of how enclosure top 8 is set upon enclosure 6, it is preferable that uncovered space 40 remains exposed such that water balloons or other projectiles may enter receptacle 10, and such that the contents of receptacle 10 be easily dumped on participants stationed below. In some embodiments top left bracket 42 and top right bracket 45 may be set two feet and eight and a half inches back from level stud 21. In such embodiments, center left bracket 43 and center right bracket 46 may be set one foot and eight and a half inches back from level stud 21. In such embodiments, bottom left bracket 44 and bottom right bracket 47 may be set eight and a half inches back from level stud 21. The distance between the brackets and level stud 21 is measured along the angles corresponding to left side frame top stud 22 and right-side frame top stud 23 respectively.

As seen in FIGS. 1-5, apertures 5 may function as windows from where balloons or other projectiles may exit enclosure 6 when launched. In some embodiments apertures 5 may be covered by protective panel 50. Protective panel 50 may serve to keep stray balloons and other projectiles from permeating aperture 5. In some embodiments each aperture 5 may be covered by a dedicated protective panel 50. Alternatively, a single protective panel 50 may sheath all apertures 5, such that when protective panel 50 is lifted all apertures 5 are exposed.

During game play protective panel 50 may be lifted such that balloons or other projective may be launched out through aperture 5. Protective panel 50 is preferably a solid, transparent, rigid sheet of material including but not limited to polycarbonate, acrylic, or plexiglass such that it can withstand impact with flying water balloons. Protective panel 50 may be, but is not necessarily, attached to aperture 5 by hinge 54 and hinge 55, such that panel 50 pivots around sideways crossbeam 35 and/or sideways crossbeam 36 (depending on which aperture 5 is being used). It is preferable that hinge 54 and hinge 55 both attach to the same side of protective panel 50 such that only one side of protective panel 50 is fixed to enclosure 6.

In some embodiments lifting cord 53 may be attached to panel 50 such that users may tug lifting cord 53 via handgrip 153 to retract panel 50. In some embodiments, when retracted, protective panel 50 may pivot around sideways crossbeam 35 or sideways crossbeam 36. In some embodiments, protective panel 50 may retract mechanically when lifting cord 53 is tugged. In some embodiments, protective panel 50 lowers back over aperture 5 due to gravity.

In some embodiments, as seen in FIGS. 2-6, lifting cord 53 may be threaded through and secured to eyelet 56, securing lifting cord 53 to protective panel 50. While eyelet 56 may be located anywhere on protective panel 50, it is preferable that eyelet 56 be rigged near protective panel edge 57 or protective panel edge 58. In some embodiments lifting cord terminal end 59 may be fastened to eyelet 56 with a knot, alternatively lifting cord terminal end 59 may be secured in any other appropriate fashion. Methods of attachment include but are not limited to glue, resin, or melting terminal end 59 into panel 50.

Figure 6:
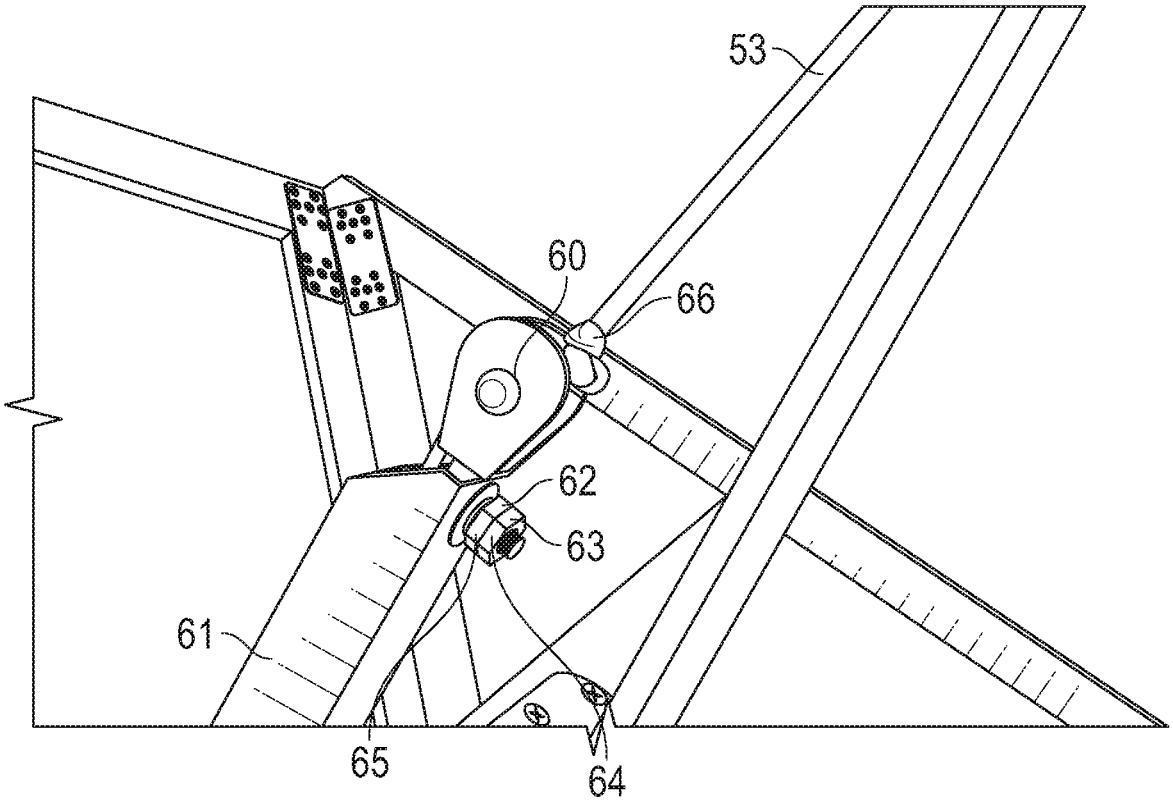
FIG. 6 is a close-up internal view of an embodiment the receptacle lifting cord.

As seen in FIG. 6, in some embodiments, lifting cord 53 extends from eyelet 56 through eye pulled 60 and into bar 61. In some embodiments, eye pully 60 may attach to the bar 61 with an array of fixtures, known to those skilled in the art, including but not limited to a bolt 62, flat washer 63, lock washer 64, and a hex nut 65. In some embodiments, stopper 66 is set along lifting cord 53, between eye pully 60 and protective panel 50. Stopper 66 may prevent lifting cord 53 from pivoting protective panel 50 more than ninety degrees from where it is attached to sideways crossbeam 35 or sideways crossbeam 36. In some embodiments, stopper 66 may be a knot in lifting cord 53.

Figure 4:
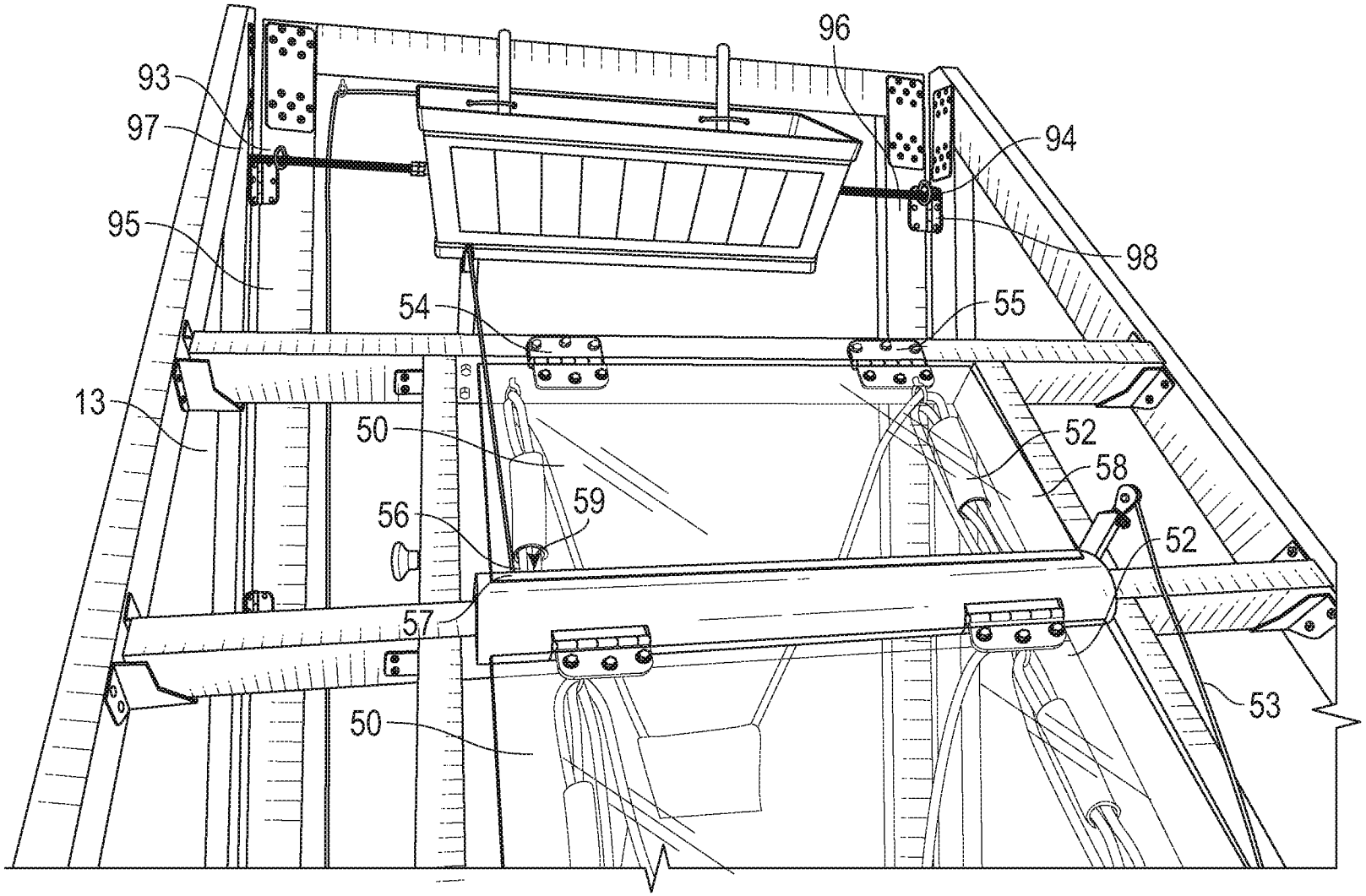
FIG. 4 is an isolated view of front top of an embodiment of the game enclosure frame that includes top framing with enclosure coupled to the receptacle.
Figure 5:
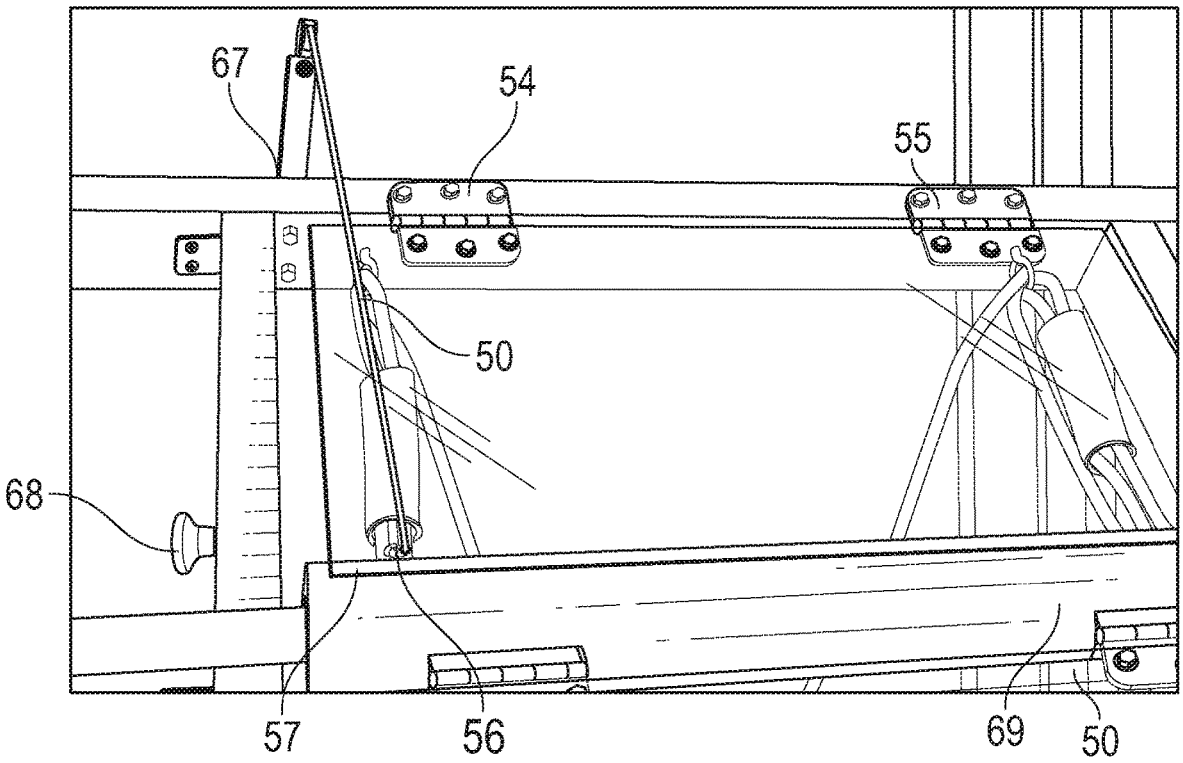
FIG. 5 is a magnified view of front top of the closed protective panel.

As seen in FIGS. 4-6, bar 61 may be mounted to crossbeam 35. In some embodiments, bar 61 may attach to back face 67 on crossbeam 35. In some embodiments, bar 61 may be, but is not necessarily, mounted to back face 67 such that bar 61 spans vertically and runs perpendicular, plus or minus fifteen degrees, to back face 67. Alternatively, bar 61 may attach to crossbeam 35, or any other crossbeam in any orientation. In some embodiments, bar 61 may have multiple points of attachment to crossbeam 35, and may be attached with standard bar attaching fasteners known to those skilled in the art. In some embodiments, lifting cord 53 may extend downward from bar 61, such that lifting cord 53 may be easily reached via handgrip 153 by participants during game play. In some embodiments, lifting cord 53 may be, but is not necessarily, attached to a handgrip 153, allowing participants to easily tug lifting cord 53. In some embodiments, excess length of lifting cord 53 may be wrapped around protrusion 68, such that excessive lifting cord 53 length is minimized. In some embodiments, Protrusion 68 may also function to lock protective panel 50 in a retracted position. For example, upon tugging lifting cord 53 to retract protective panel 50, participants may tightly wrap lifting cord 53 around protrusion 68 such that protective panel 50 is secured to protrusion 68 via lifting cord 53, preventing protective panel 50 from lowering over aperture 5. In some embodiments, excess lifting cord 53 may additionally be secured to tie location 168, such that lifting cord 53 is securely fastened, preventing protective panel 50 from lowering over aperture 5 during a launch.

In some embodiments a means for launching balloons or other projectiles may be used to cast the balloons or other projectiles at an opponent's receptacle 10. The means for launching balloons and/or other projectiles may be a player's body. Preferably, the means for launching balloons and/or other projectiles may be an apparatus such as but not limited to launcher 52. Launching apparatuses may be attached or unattached to enclosure 6. In an embodiment, launcher 52 may be fixed to the crossbeams forming the perimeter of aperture 5. In some embodiments, launcher 52 may be attached to protective panel 50 such that protective panel 50 retracts when launcher 52 is pulled back. It is worth noting that while the present description describes the mechanics behind launcher 52 attachment and panel 50 retraction for one aperture 5, enclosure 6 may be constructed with multiple apertures 5. The mechanics herein may be used for any and all apertures 5 constructed in enclosure 6.

In some embodiments, during gameplay, protective panel 50 may be retracted when participants are launching balloons or other projectiles, at all other times, protective panel 50 may sheathe aperture 5 such that balloons or other projectiles cannot enter enclosure 6 through aperture 5. As seen in FIGS. 4-5, in some embodiments, protective panel 50 may extend from sideways crossbeam 35, where hinge 54 and hinge 55 attach protective panel 50 to enclosure 6, to sideways crossbeam 36. In embodiments of enclosure 6 featuring a plurality of apertures 5, a second protective panel 50 may extend from sideways crossbeam 36 to sideways crossbeam 37. It is preferable that sideways crossbeam 36, and in some embodiment's sideways crossbeam 37, be sheathed or wrapped in covering 69, fashioned from foam or other such protective material, such that covering 69 may serve as a noise buffer when panel 50 reverts over aperture 5, and the surrounding beams. Additionally, covering 69 may function to soften the impact between protective panel 50 crossbeam 36, and potentially crossbeam 37 such that protective panel 50 is protected from cracking, breaking or shattering upon impact with crossbeam 36 and possibly crossbeam 37.

Figure 7:
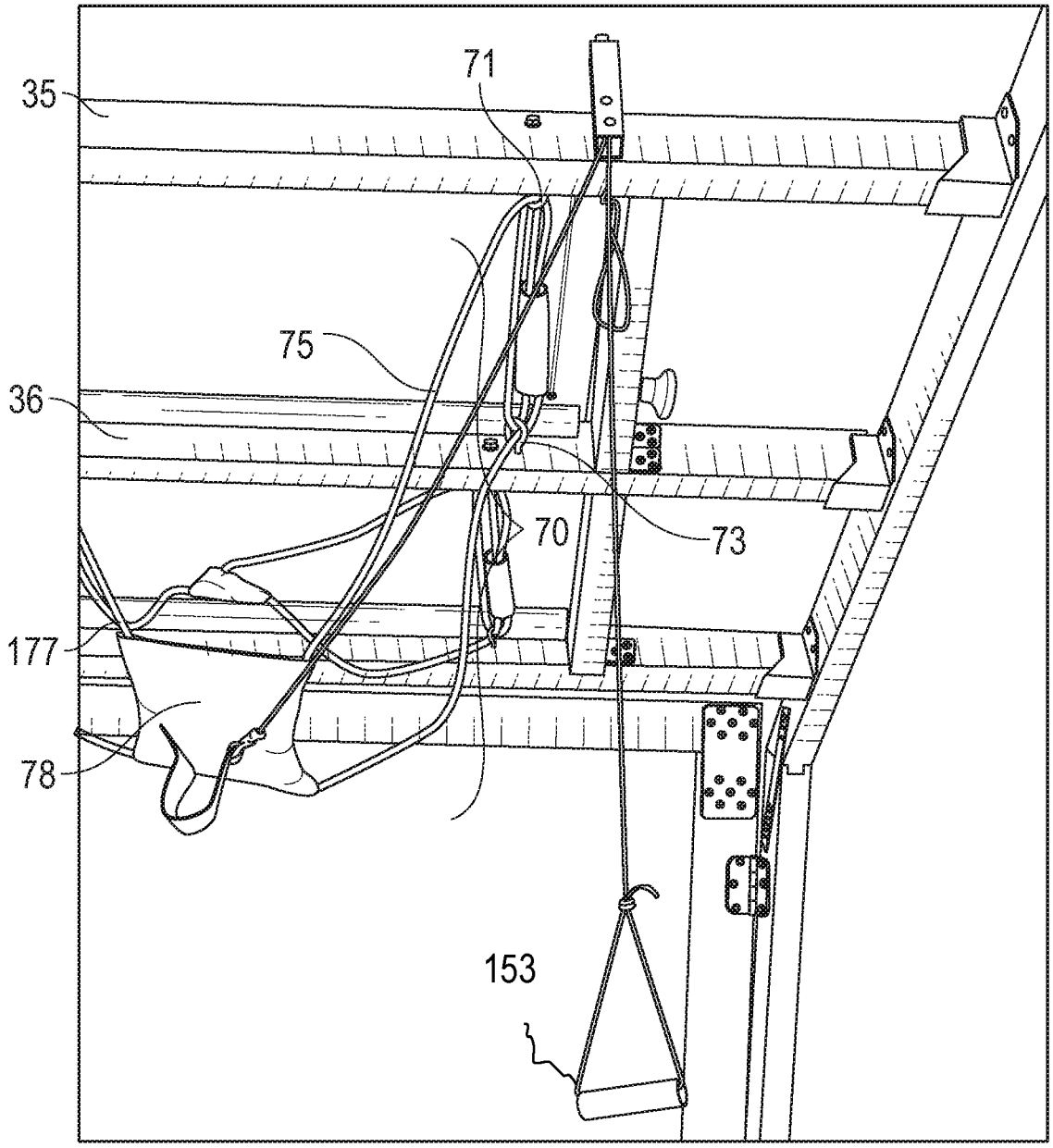
FIG. 7 is a magnified view of an embodiment of a launching device from within an example of the game enclosure frame.
Figure 8:
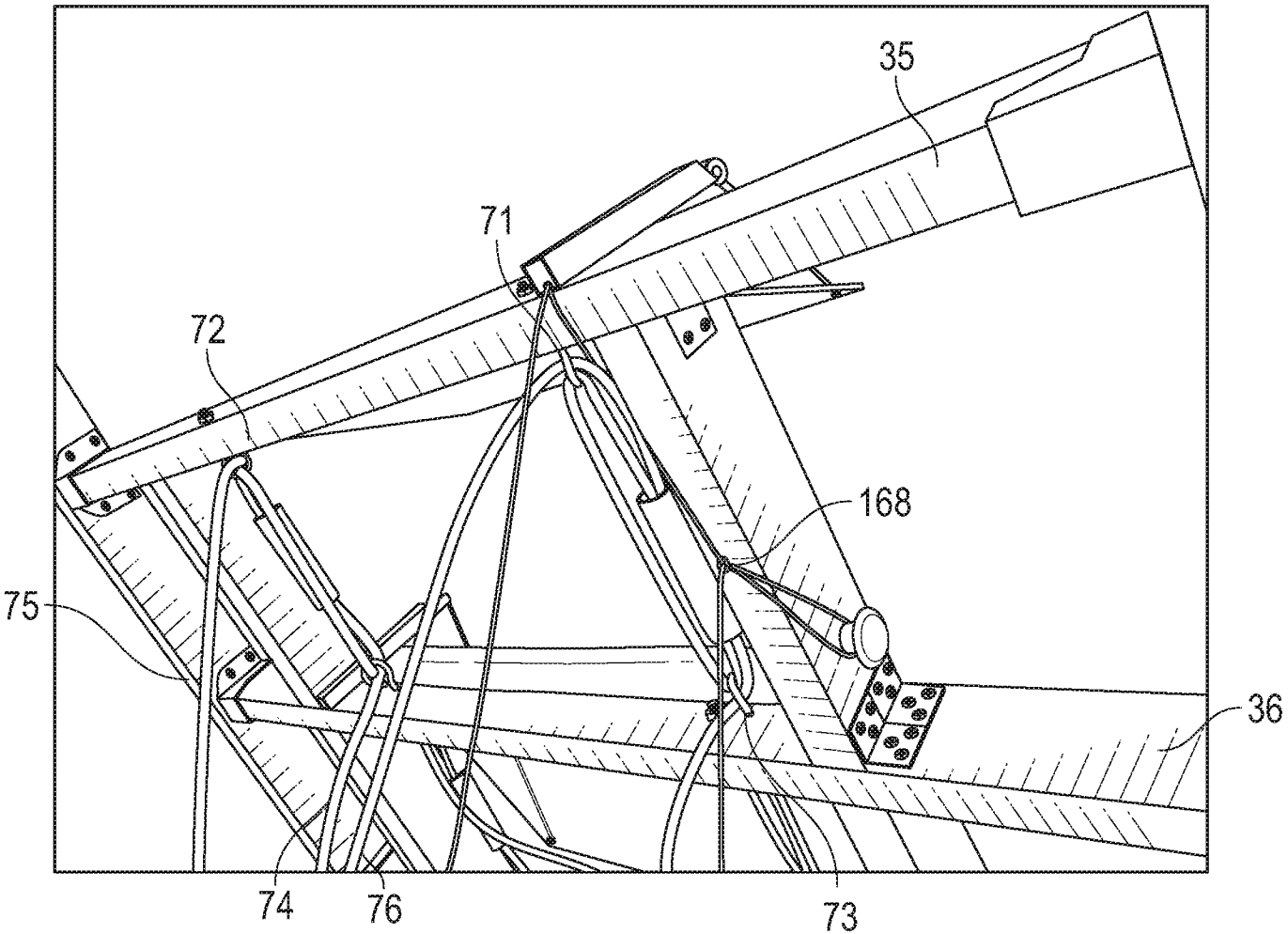
FIG. 8 is an internal forward view of an embodiment of a launching device coupled to an embodiment of the game enclosure frame.

As seen in FIGS. 6-8, water balloons or other projectiles may be thrown or launched from within enclosure 6. In some embodiments participants use their bodies, such as their arms and hands, to throw or launch water balloons or other projectiles from within enclosure 6. Alternatively, water balloons may be thrown or launched from within enclosure 6 via a launching apparatus. Such launching apparatuses include, but are not limited to, elastic slingshots, pneumatic launchers, hydraulic launchers, magneto launchers, or servo electric launchers. In some embodiments, enclosure 6 includes multiple apertures 5, such that each aperture is set with its own launching apparatus. Alternatively, a single launching apparatus may be used to launch balloons or other projectiles out through multiple apertures 5. In other embodiments, a plurality of launching apparatuses may be employed, such that the launching apparatuses are interchangeable, allowing for each apparatus to be used in any of apertures 5. In some embodiments, only one aperture 5 is present in enclosure 6. The single aperture 5 may be set with a single launching apparatus. Alternatively, the single aperture 5 may be set with multiple launching apparatuses. In any other of the embodiments, the launching apparatus(es) may be fixed with enclosure 6. Alternatively, in any of the embodiments, the launching apparatus(es) may be unattached to enclosure 6. Any alternative combination of apertures and embodiments are also suitable for use in the present invention, and the above examples are not intended to limit the scope of the invention in any way.

One example of a suitable balloon launcher embodiment may be seen in FIG. 6-8. As seen in FIG. 6 elastic balloon launcher 70 may be set below aperture 5 such that balloons or other such projectiles may be cast out of aperture 5 as facilitated by balloon launcher 70. In some embodiments elastic balloon launcher 70 may be attached to enclosure 6 via elastic eyebolt 71, elastic eyebolt 72, elastic eyebolt 73, and elastic eyebolt 74. As seen in FIG. 7 elastic eyebolt 71 and elastic eyebolt 72 may be fixed to opposite ends of sideways crossbeam 35, while elastic eyebolt 73 and elastic eyebolt 74 may be fastened to opposite ends of sideways crossbeam 36. Elastic eyebolt 71, elastic eyebolt 72, elastic eyebolt 73, and elastic eyebolt 74 may be secured by any means known to those skilled in the art including, but not limited to with hardware such as flat washers and nuts.

In some embodiments, elastic cords 75 are strung through each of the aforementioned eyebolts. In some embodiments, a total of two elastic cords 75 are utilized, such that one cord 75 is strung between two eyebolts. Alternatively, a plurality of cords 75 may be strung through a single eyebolt for added strength, durability, and tension. In some embodiments, a single cord 75 may be wrapped around an eyebolt multiple times. In some embodiments eyebolt 71 and eyebolt 72 share cord 75, and eyebolt 73 and eyebolt 74 share cord 75. Alternatively, eyebolt 71 and 73 may share cord 75, while eyebolt 72 and 74 share cord 75. In some embodiments, opposite eyebolts may share cord 75, such that the cords form a crisscross formation.

It is preferable that cord 75 be long enough to allow for excess cord 76 to hang down from each eyebolt, such that excess cord 76 may make up the length of elastic launcher 70. In some embodiments, it is preferable, eyebolt 71, eyebolt 72, eyebolt 73, and eyebolt 74 may each furnish excess cord 76 of the same length. Alternatively, the length of excess cord may vary between eyebolt 71, eyebolt 72, eyebolt 73, and eyebolt 74. In some embodiments, the open sides of eyebolt 71, eyebolt 72, eyebolt 73, and eyebolt 74 are recessed into sideways crossbeam 35 and sideways crossbeam 36, respectively, securing cord 75 within each eye.

As seen in FIG. 7, in some embodiments, elastic cord terminal ends 177 may converge to form platform 78, whereupon balloons or other projectiles may rest while being launched. Platform 78 may be made out of any suitable material, including but not limited to fabric, plastic, mesh, or cardboard. In some embodiments, platform 78 may have a textured or non-slip surface to prevent slippage during a launch.

To operate elastic launcher 70, platform 78 may be pulled downward, such that cords 75 are stretched, and potential energy is stored. The balloon or other projectile may be placed upon platform 78 before or after platform 78 is pulled downward. When platform 78 is released, cords 75 suddenly contract, causing the stored potential energy to convert to kinetic energy, propelling the balloon or other projectile out through aperture 5. In some embodiments, enclosure 6 contains a plurality of launchers of different heights. In some embodiments, the launchers may additionally, or alternatively be of different strengths. In some embodiments, the launchers, such as elastic launcher 70 may be equipped with force limiters to prevent the balloons from flying excessively high or far. In some embodiments, the pulling back of launcher 70 may mechanically lift protective panel 50, such that participants will not have to separately remove panel 50 from aperture 5 before launching water balloons or other such projectiles.

Figure 15:
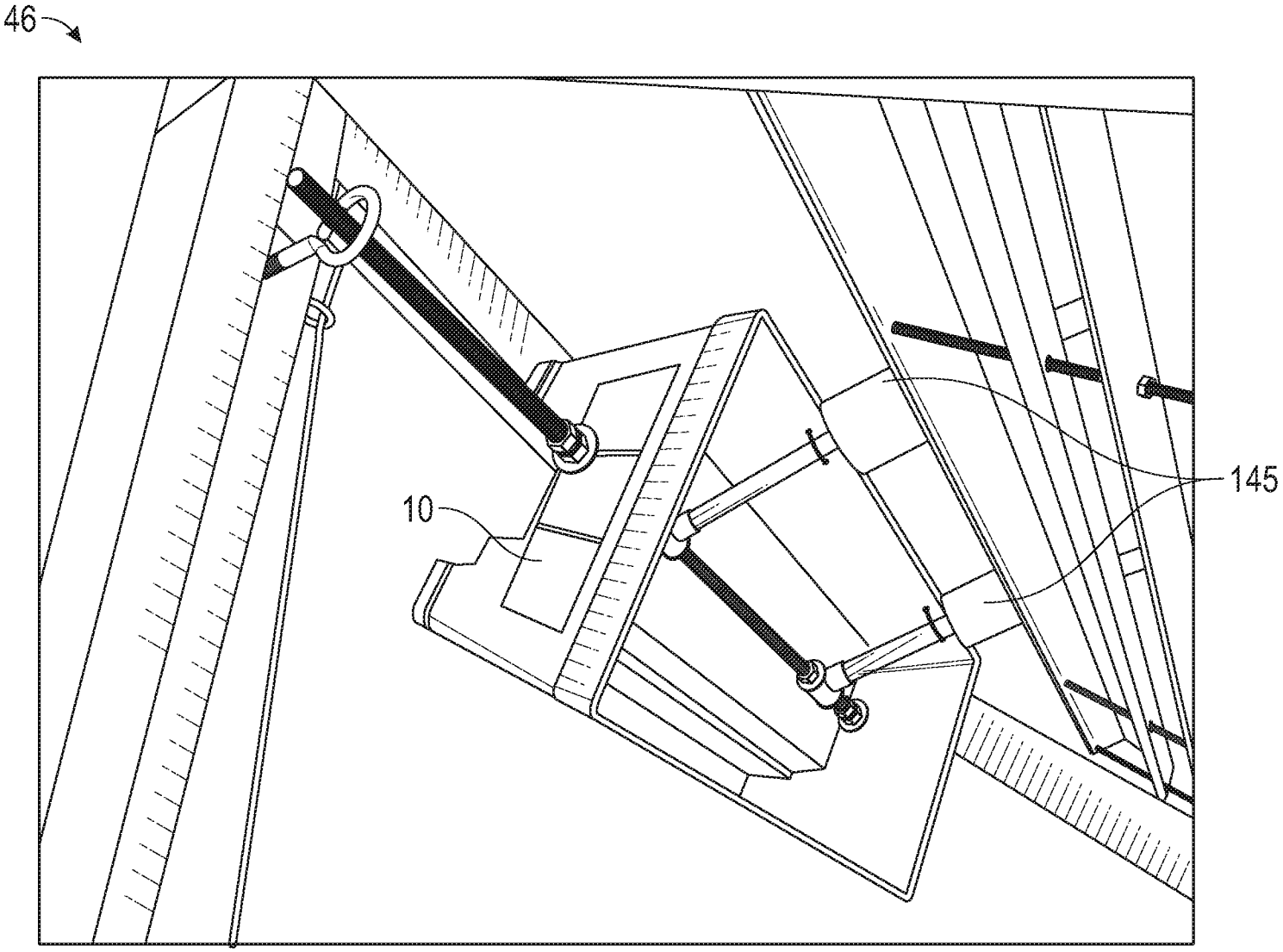
FIG. 15 is a side perspective view of an embodiment of the present invention top portion with upturned receptacle.

During a launch, the balloon or other projectile may be aimed at the opponent's receptacle 10, such that if the balloon or other projectile lands in the receptacle 10, it will pop or otherwise release its contents therewithin When receptacle 10 fills with the requisite mass of liquid or other material receptacle 10 may upend, soaking or otherwise dousing the player stationed within enclosure 6 with the contents of receptacle 10. Receptacle 10 is useful when coupled or set above enclosure 6. An example of upended receptacle 10 is shown in FIG. 15.

In some embodiments, receptacle 10 may be fashioned out of plastic, acrylic, plexiglass or other such suitable, materials. It is preferable that receptacle 10 be constructed from nonporous, water-resistant materials. In some embodiments receptacle 10 is constructed from hydrophobic materials. In some embodiments receptacle 10 may be a receptacle. Alternatively, receptacle 10 may be a bin, or any other suitable vessel. It is preferable that receptacle 10 be capable of containing liquids.

As seen in FIGS. 9-12, in preferred embodiments, the base of receptacle 10 may be constructed from receptacle deep bottom 77 and receptacle shallow bottom 78. In some embodiments, the base of receptacle 10 has an additional angled component, receptacle slanted bottom 79, between receptacle deep bottom 77 and receptacle shallow bottom 78. Receptacle's 10 uneven base may facilitate the flow of liquid or other materials toward the front of receptacle 10, front wall 84, enabling receptacle 10 to upend when filled with the requisite amount of material.

In some embodiments receptacle 10 may be constructed from a plurality of exterior walls, such as but not limited to four exterior walls. In some embodiments, receptacle 10 may be constructed from left wall 82, right wall 83, front wall 84, and back wall 85.

Figure 9:
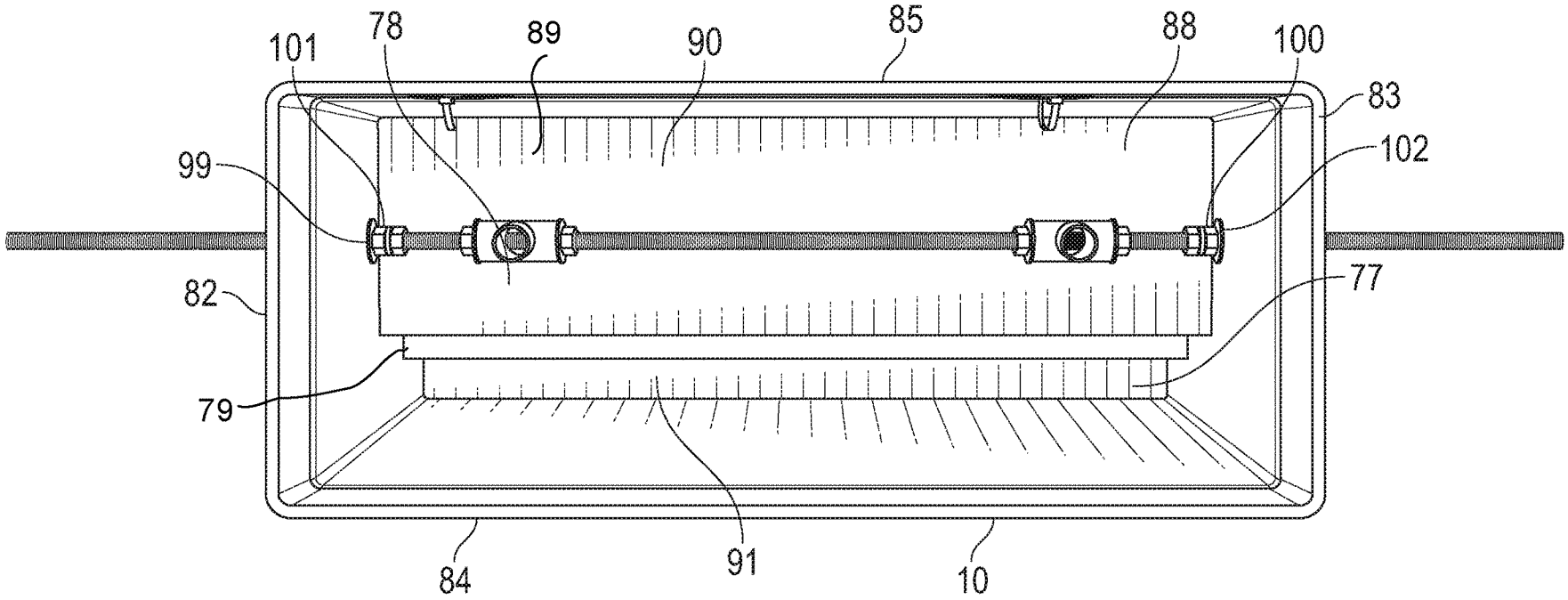
FIG. 9 is a top view of an exemplary receptacle.

In one embodiment, as seen in FIG. 9, receptacle 10 may be constructed from tiered base 81 such that tiered base 81 is constructed from multiple levels. In some embodiments, tiered base 81 may be symmetrical such that at receptacle shallow bottom 78 is set at the very center of tiered base 81. Alternatively, tiered base 81 may be asymmetrical. In some embodiments, receptacle shallow bottom 78 wholly extends from left sidewall 82 to right sidewall 83. Front moderately shallow bottom 80 may be set in front of receptacle shallow bottom 78. Similarly, back moderately shallow bottom 86 may be set behind receptacle shallow bottom 78. In some embodiments front moderately shallow bottom 80 and back moderately shallow bottom 86 may extend from left sidewall 82 to right sidewall 83. Front receptacle deep bottom 77 may be set between moderately shallow bottom 80 and front wall 84. Similarly, back receptacle deep bottom 87 may be set between back moderately shallow bottom 86 and back wall 85. Both front receptacle deep bottom 77 and back receptacle deep bottom 87 may extend from left sidewall 82 to right sidewall 83. In some embodiments, each level connects to the one above it with an upright wall, such that front receptacle deep bottom 77 connects to front moderately shallow bottom with upright wall 156, front moderately shallow bottom 80 connects to receptacle shallow bottom 78 with upright wall 157, receptacle shallow bottom 78 connects to back moderately shallow bottom 86 with upright right wall 159, and back moderately shallow bottom connects to back receptacle deep bottom with upright wall 158. In some embodiments, some or all of the upright walls may be perpendicular to the receptacle bottom 281. Alternatively, some or all of the upright walls may form acute or obtuse angles with receptacle bottom 281 (not pictured in FIG. 9). In embodiments where tiered base 81 is employed, it is preferable that left sidewall 82 and right sidewall 83 are shaped to accommodate tiered base 81.

In an alternative embodiment, the base of receptacle 10 may be slanted rather than tiered, such that the slant promotes the flow of materials toward front wall 84 of receptacle 10. For example, as seen in FIG. 9, slanted receptacle bottom 181 may be constructed from front receptacle deep bottom 77, receptacle shallow bottom 78, and slanted bottom 79. Front receptacle deep bottom 77 may be joined with receptacle shallow bottom 78 via slanted bottom 79. The angle joining front deep receptacle bottom 77 to receptacle shallow bottom 78 is preferably larger than 90 degrees and less than 180 degrees. It is preferable that the angle ranges between one hundred degrees and one hundred sixty degrees. It is worth noting that any angle that promotes the flow of materials towards front wall 84 may be suitable. In such embodiments, where slanted bottom 79 is employed to facilitate the flow of water towards front wall 84, it is preferable that left sidewall 82 and right sidewall 83 by shaped to accommodate the slanted base. In an alternative embodiment, the entire base of receptacle 10 may be slanted, such that materials will flow towards front wall 84.

Figure 10:
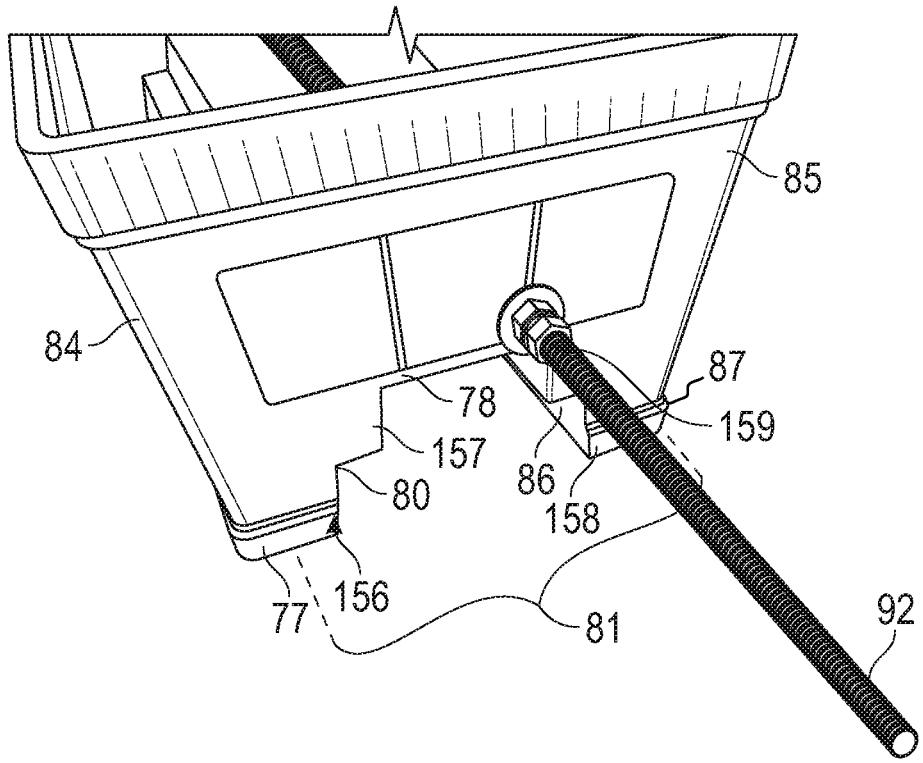
FIG. 10 is a perspective side view of an example of an alternative receptacle.

In some embodiments, as seen in FIG. 9-10, back section 88 may contain weights 89 and foam 90. Weights 89 may offset receptacle's 10 center of gravity, such that receptacle 10 will only upend when a requisite amount of material flows toward front wall 84. Foam 90, serves the purpose of displacing the material deposited by the balloons or other projectiles from back section 88 towards front section 91. Weights 89 may be fashioned from stone, metal, or any other suitable, weighted materials. Weights 89 and foam 90 may be fastened to the receptacle 10 with any suitable means including resin, water-resistant glue, or appropriate hardware known to those skilled in the art. In some embodiments back section 88 is lesser in volume than front section 91. Alternatively back section 88 and front section 91 may be identical in side. In some embodiments, back section 88 is larger in volume than front section 91.

Weights 89 may counterbalance receptacle 10, ensuring that receptacle 10 will not overturn until a requisite weight of material accumulates in said receptacle 10. In some embodiments, the requisite weight may be defined as the mass of the material intended to be dumped (e.g., a multiple or fraction of liquid contained in a single balloon or projectile). The total heft of weights 89 and foam 90 is preferably less than the requisite weight, and greater than the requisite weight minus the mass of one balloon or projectile's worth of material. If the total mass of weights 89 and foam 90 is too low, receptacle 10 may overturn prematurely, and players may not be satisfactorily drenched. The following is example is exemplary in nature and not meant to limit the scope of the invention in any way. In the interest of simplicity, the following example neglects the displacement of the axis of rotation relative to the central axis and the weight of the bucket. The following example also neglects to consider the weight of the flag and flag frame. For example, assuming that each water balloon or other projectile contains approximately one hundred eighty grams of water, if it is desired that receptacle 10 overturn after seven water balloons land within it, the total mass of weights 89 and foam 90 is preferably between one thousand eighty grams (the mass of water in six water balloons) and one thousand two hundred twenty-five grams (the mass of water in seven water balloons minus fifteen grams). It should be noted that the front of the receptacle 10 may be prefilled with liquid or other material, such that fewer balloons or other projectiles are necessary to upend receptacle 10. In some embodiments, receptacle 10 may be fastened to enclosure 6 via rod 92. Rod 92 may run through one or a plurality of receptacle's 10 walls while also being attached to enclosure 6. In one embodiment rod 92 impales receptacle 10, running through both left sidewall 82 and right sidewall 83. In such embodiments, it is preferable that rod 92 be set over back section 88, offsetting receptacle 10's center of gravity. In an alternative embodiment rod 92 may be set over the center of receptacle 10. In some embodiments, rod 92 may be set over front section 91.

In some embodiments, rod 92 may be fastened to enclosure 6, such that receptacle 10 is suspended over the participant(s). In some embodiments rod 92, and therefore receptacle 10, may be fastened over, or within uncovered space 40 such that balloons or other projectiles may readily enter receptacle 10. In an embodiment, as seen in FIG. 3 and in FIG. 11, rod 92 may be fastened to back frame 2 with left stud eyebolt 93 and right stud eyebolt 94. In some embodiments, left stud eyebolt 93 may be fastened to left upright back stud 95, while right stud eyebolt 94 may be attached to right upright back stud 96. In some embodiments, left stud eyebolt 93 and right stud eyebolt 94 may be fastened at the same height. Alternatively, left stud eyebolt 93 and right stud eyebolt 94 may be fastened at different heights, such that when rod 92 is set between left stud eyebolt 93 and right stud eyebolt 94 rod 92 will be set on a slant. Left rod end 97 may be threaded through left stud eyebolt 93, while right rod end 98 may be threaded through right stud eyebolt 94.

To install rod 92, it is preferable to rod 92 first be set within receptacle 10, and then be fixed to enclosure 6. In one embodiment left opening 101 is made in left sidewall 82 and right opening 102 is made in right sidewall 83 such that rod 92 may pass through both openings. It is preferable that left opening 101 and right opening 102 be sealed with left gasket 99 and right gasket 100 respectively, such that liquid and other materials are inhibited from flowing out of receptacle 10 through left opening 101 and right opening 102. While rod 92 may be secured to receptacle 10 with any means known to those skilled in the art, is some embodiments hardware including but not limited to hex nuts, lock washers and flat washers may be suitable for fixing rod 92 to receptacle 10.

Figure 12:
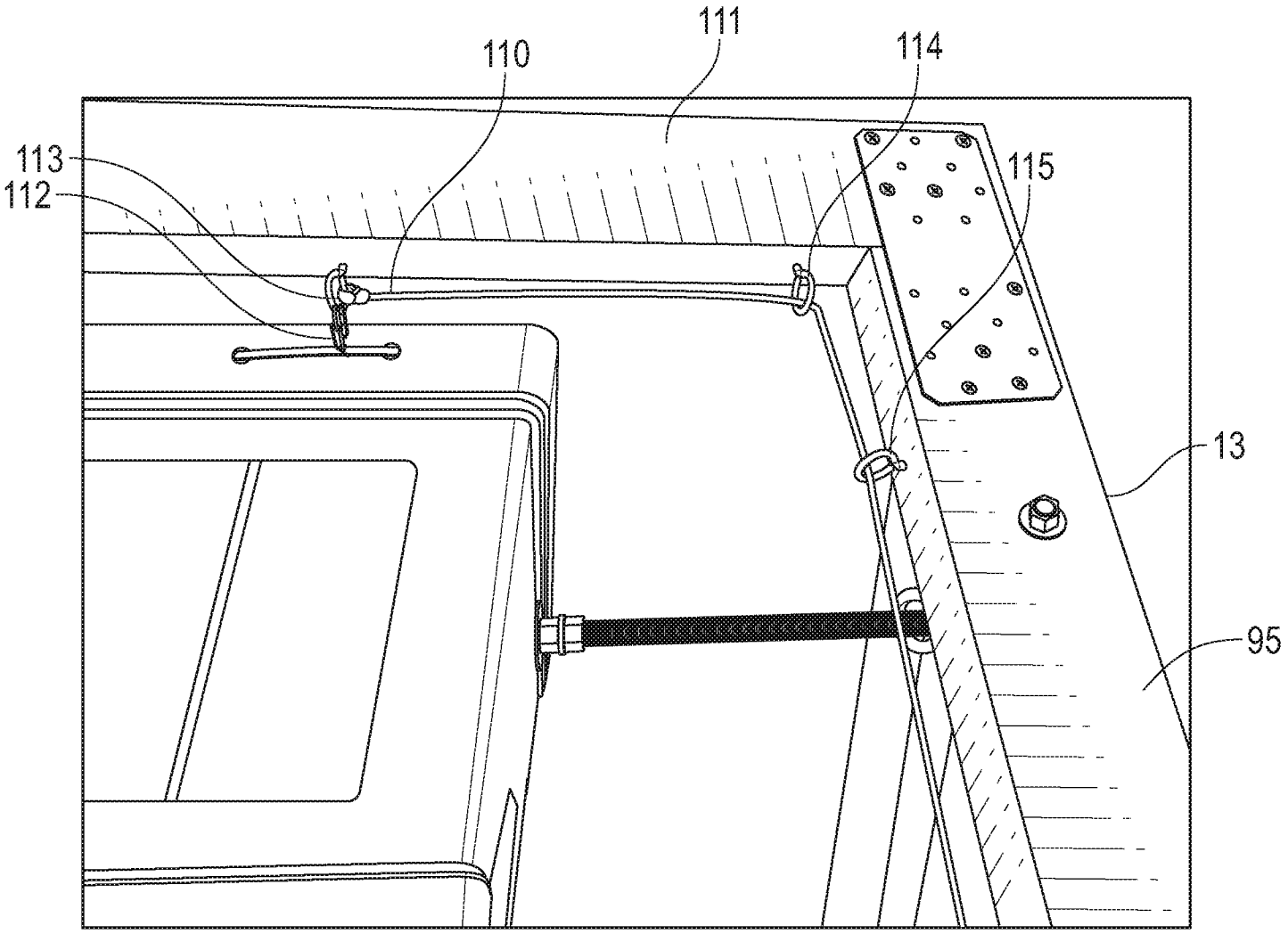
FIG. 12 is a magnified forward view of an example of the receptacle coupled to an embodiment of the game enclosure.

As seen in FIG. 4 and FIG. 12, in some embodiments, rod 92 may be attached to enclosure 6 by being threaded through left stud eyebolt 93 and right stud eyebolt 94. It is preferable that after being threaded through both eyebolts, the length of rod 92 extend entirely from left side frame back stud 13 to right side frame back stud 16 such that left side frame back stud 13 and right-side frame back stud 16 may function as stoppers to prevent rod 92 from oscillating laterally. It is important to note that in some embodiments, when receptacle 10 is properly replete with liquid or other such materials, rod 92 rotates, preferably forwards 103, causing receptacle 10 to overturn. Therefore, in such embodiments, while the length of rod 92 may extend from left side frame back stud 13 to right side frame back stud 16, rod 92 should not be so firmly packed between the two studs as to hinder rod's 92 forward rotation 103.

In an alternative embodiment, receptacle 10 may attach to enclosure 6 via a curved or angular shaft 105 such that shaft 105 attaches to receptacle 10 via hinges, bolts or other such means known to those skilled in the art. In some embodiments shaft 105 may be hung from enclosure 6 via a hook or other such hardware. Alternatively, shaft 105 may be fixed to enclosure 6 with fasteners. In some embodiments it is preferable that shaft 105 have a flexible connection with receptacle 10 such that receptacle 10 may swing or pivot. In such embodiments receptacle 10 may pivot or overturn when replete with liquid while shaft 105 may remain stationary.

In other embodiments a series of pullies or levers may support receptacle 10, enabling receptacle 10 to overturn when appropriate conditions are met. Alternatively, a latch may support receptacle 10, enabling receptacle 10 to overturn when appropriate conditions are met. In other embodiments, receptacle 10 may be fixed to enclosure 6 via attachments along receptacle bottom 281. For example, a series of clamps may attach receptacle bottom 281 to enclosure 6 in such a way that receptacle 10 is free to upend when appropriate conditions are met.

In an alternative embodiment, receptacle 10 may upend when a requisite weight of material is deposited into receptacle 10 because the weight of the material triggers a connection between enclosure 6 and receptacle 10 to release. Any mechanism by which materials may be released from receptacle 10 when triggered by a requisite mass or volume of material is suitable for use with the balloon dumping game described herein.

Figure 11:
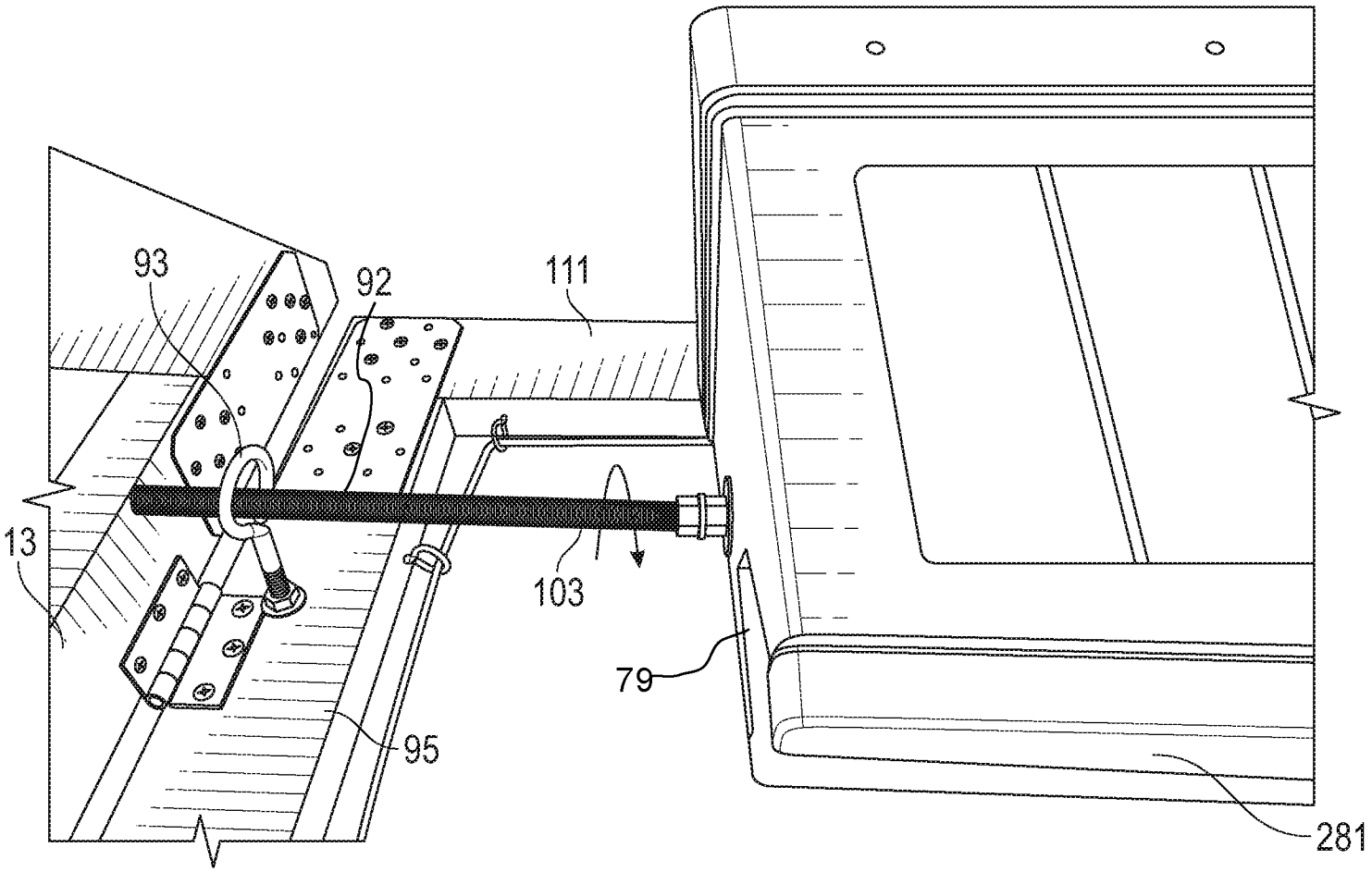
FIG. 11 is a side view of an embodiment of the receptacle coupled to a frame via bar.

As seen in FIG. 11 and FIG. 12, lifting cord 110, extends downward from receptacle 10, such that participants can turn receptacle 10 upright after it upends at the end of a game. In some embodiments, lifting cord 110 may be attached at the top of backwall 85 with carabiner 112. Carabiner 112 may be a metal loop that may be constructed with a spring-loaded gate, providing a secure connection for lifting cord 110. Lifting cord 110 may extend from carabiner 112 through lifting cord eyebolt 113, lifting cord eyebolt 114, and lifting cord eyebolt 115. In some embodiments, lifting cord eyebolt 113 and lifting cord eyebolt 114 may be installed along back sideways beam 111. Lifting cord eyebolt 115 may be installed along upright back stud 95. In some embodiments, lifting cord eyebolt 113 and lifting cord eyebolt 114 may be installed such that their eyelets are downward facing. Lifting cord eyebolt 115 may be installed in upright back stud 95 such that the eyelet faces inwards, pointing towards receptacle 10. After passing through lifting cord eyebolt 113, lifting cord eyebolt 114, and lifting cord eyebolt 115, lifting cord 110 may freely hang down, such that participants may tug lifting cord 110 to turn receptacle 10 upright and restart a game.

As seen in FIG. 13, receptacle 10 may be coupled to flag 116 such that participants are quickly alerted when receptacle 10 overturns. In some embodiments, flag 116 may be coupled to rod 92. Alternatively, flag 116 may be directly coupled to receptacle 10. In some embodiments, flag 116 may be fashioned from fabric, plastic, mesh, or any other suitable material. Flag 116 may be foldable or rigid. In some embodiments, flag 116 may function as a backboard such that balloons and other projectiles may rebound off of flag 116 and into receptacle 10.

As seen in FIG. 13, flag 116 may be attached to receptacle 10 or rod 92 by left flag holder 117 and right flag holder 118. In some embodiments portions of left flag holder 117 and right flag holder 118 may be sheathed in protective coating 145. Protective coating 145 may include but is not limited to foam or bubble wrap. As seen in FIG. 15, protective coating 145 may sheath flag holder 117 and flag holder 118 such that when receptacle 10 overturns, left flag holder 117 and right flag holder 118 will be protected from impact with enclosure 6. Additionally protective coating 145 may muffle the noise produced by the impact between enclosure 6, flag holder 117, and flag holder 118.

In some embodiments left flag holder 117 and right flag holder 118 may be coupled to rod 92 or receptacle 10 via left tee connector 119 and right tee connector 120 respectively. In some embodiments, left tee connector 119 and right tee connector 120 may slide along rod 92 or receptacle 10, such that the width of flag 116 may be adjusted, allowing for an adjustable backboard. An adjustable backboard may suit players of different skill levels. For example, beginners may prefer a large flag 116 backboard such that balloons and other projectiles may rebound off of a large area, and into receptacle 10. Similarly, advanced players may prefer a smaller area from which balloons and other projectiles may rebound into receptacle 10, and thereby choose to shrink down flag 116.

Figure 14:
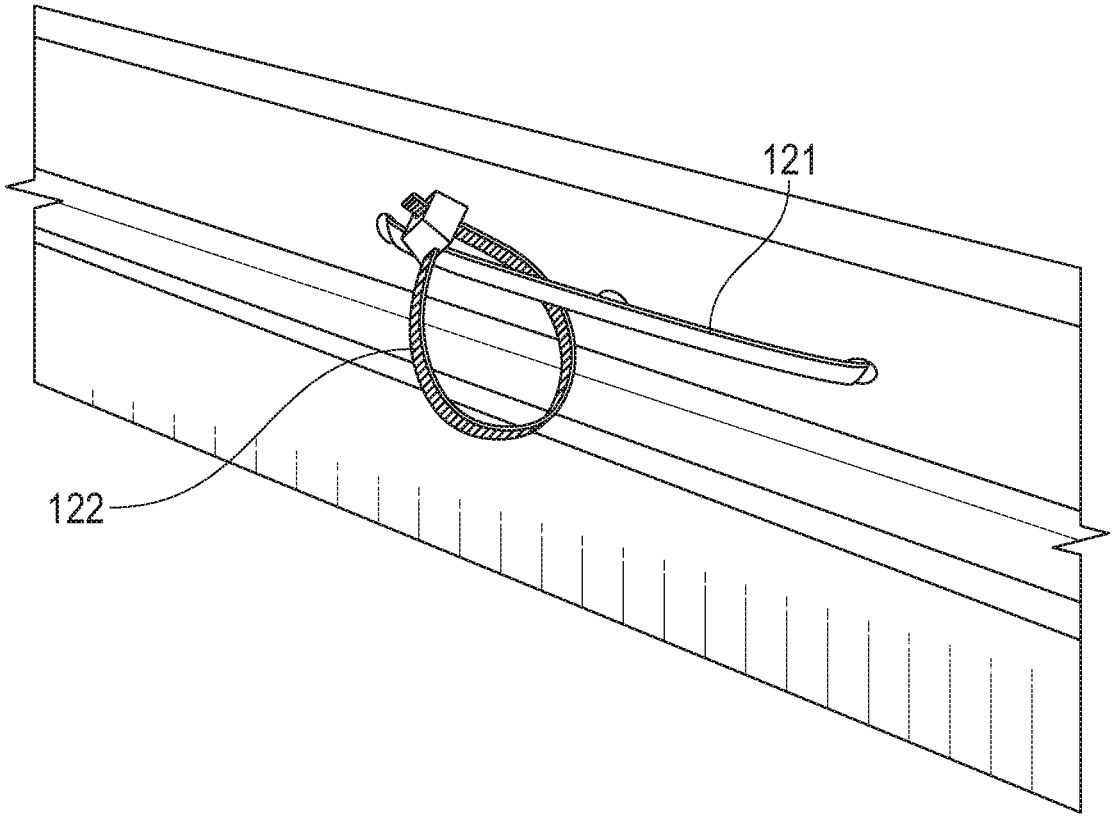
FIG. 14 is a side view of an example of a flag rail coupled to an example of a flag clamp.

As seen in FIGS. 13-15, in addition to being supported by left tee connector 119 and right tee connector 120, left flag holder 117 and right flag holder 118 may additionally be affixed to receptacle 10 with top rail 121 and top clamp 122. In some embodiments a single, long top rail supports both left flag holder 117 and right flag holder 118. Alternatively, left flag holder 117 may supported by one top rail 121 and top clamp 122, while right flag holder 118 may be supported by a separate top rail 121 and top clamp 122. It is preferable that top clamp 122 slide along top rail 121 such that the width of flag 116 may be adjusted. Top rail 121 and top clamp 122 may be constructed from plastic, metal, fabric, yarn, or any other suitable material. In some embodiments top rail 121 and top clamp 122 may be constructed from zip ties. It is preferable that top rail(s) (121) have a broad span, allowing for a wide range of adjustment possibilities for flag 116. Flag 116 may be fastened to top rail 121 by top clamp 122 such that when top clamp 122 moves along top rail 121 the width of flag 116 changes.

In some embodiments, as seen in FIG. 13, flag 116 may be fastened to frame 123. Frame 123 may be constructed from top rod 124, bottom rod 125, left rod 126, and right rod 127. It is preferable that top rod 124 and bottom rod 125 have adjustable lengths such that the width of flag 116 may be adjusted. In some embodiments top rod 125 is coupled to left rod 126 and right rod 127 via left elbow fitting 128 and right elbow fitting 129. Similarly, bottom rod 125 may be coupled to left rod 126 and right rod 127 via left frame tee connector 130 and right frame tee connector 131. Alternatively, the rods may be glued, soldered, or fixed to each other in any other way known to those skilled in the art. In some embodiments, top rod 124 is congruent to bottom rod 125 and left rod 126 is congruent to right rod 127 such that frame 123 is rectangular in shape. Alternatively, frame 123 may be any alternative shape such as, but not limited to, round, quadrilateral, pentagonal, hexagonal, heptagonal, octagonal etc. In some embodiments left flag holder 117 and right flag holder 118 may attach to frame 123 by joining with left frame tee connector 130 and right frame tee connector 131 respectively. Alternatively, flag 116 may be coupled to left flag holder 117, right flag holder 118, rod 92, or receptacle 10 in any other means known to those skilled in the art.

In some embodiments, the left rod 126 and right rod 127 may be adjustable such that the height of flag 116 may be adjusted to further adjust the backboard. The adjustable rods may be comprised of multiple sections that can be extended or retracted, with extension mechanisms such as twist and lock extensions, telescopic extensions, and spring-loaded extensions. To adjust the length of an adjustable rod, one may twist, slide, or pull the sections to achieve the desired length. Once the desired length is reached, the rod is secured in place using a locking mechanism or by tightening a screw or knob.

In some embodiments, as seen in FIG. 13, flag 116 may be fastened to frame 123. Alternatively, flag 116 may be rigid and thereby not require the support of frame 123, and therefore some embodiments of the herein described balloon dumping game may not utilize frame 123. In other embodiments flag 123 may be fixed to top rod 124 and bottom rod 125. Alternatively flag 116 may be fixed to left rod 126 and right rod 127. In some embodiments flag 116 may be fixed to all rods that construct frame 123. In some embodiments flag 116 is fixed to the rods by first being wrapped around the rods, and then being folded over itself and sewn shut. It is preferable that flag 116 be loosely wrapped around the rods, such that flag 116 can slide along the rods for size adjustment.

During competitive game play, various permutations of enclosure configuration, setup, and station are contemplated and suitable. The following examples are exemplary in nature and not intended to limit the scope of the present invention. For example, a single enclosure may be utilized such that participants may cast balloons or other projectiles at a player standing within enclosure 6. The participant who successfully upend receptacle 10, causing the contents of the balloons or other projectile to be dumped over the player within enclosure 6, emerges as the game winner. An alternative setup includes two enclosures 6 with at least one player housed in each enclosure. Participants in one enclosure 6 may launch balloons or other projectiles at receptacle 10, coupled to their opponent's enclosure 6. The participant who successfully upends their opponent's receptacle 10, as broadcast by the tipping of opponent's flag 116, emerges as the winner. As an alternative, three or more enclosures 6, housing one or more players, may be used with the enclosures 6 set up at points of a polygonal arrangement facing the center. In another alternative arrangement, a multitude of enclosures 6 may be arrayed in two lines facing one another, or displayed along an obstacle course, whereby a mobile player (outside of any enclosure 6) is required to attack enclosure 6 while avoiding their own splash attacks from the player in the enclosures 6. A limitless number of alternative arrangements allow for operative competitive play, and are suitable uses for the competitive launching apparatus disclosed herein. During game play, participants may launch water balloons, other liquid-filled devices, or other projectiles out through aperture 5. Aperture 5 may be closed when the player is not launching, to provide for safety such that errant launched water balloons cannot directly enter the enclosure through aperture 5 and strike the player.

Upon launch, balloons, or alternative liquid filled devices, or other projectiles may be aimed at the opponent's receptacle 10, which may be coupled to enclosure 6.

After one or more successfully aimed shots from the opponent, the frontmost section of receptacle 10, front deep bottom 77, may fill with the contents of the balloons or other projectile, causing receptacle 10 to overturn, and to release its contents on the participant stationed below. Thus, the participant may be drenched with the contents of the balloons or other projectile Receptacle 10 may be coupled to flag 116, such that when receptacle 10 upends, flag 116 also tips, alerting participants to the tipping of the receptacle (i.e., victory), such that a winner of the quick-paced game can easily be determined. Alternatively, flag 116 may alert participants that a player is disqualified from further participation during the game round. The winner of the game is the player who overturns their opponent's receptacle first. Alternatively, in a game with three or more enclosures 6 the last player to be doused wins. The game round can be restarted when one, or all of receptacles 10 empty. Alternatively, the game round may restart when one or all of receptacles 10 are set upright.

I claim:

1. A competitive ballistic water dunking game apparatus comprising:

a shelter comprising a forward section and a back section, a top section and two side sections, said shelter having a bottom mounted onto a lower surface, said shelter comprising a first forward panel comprising at least one aperture;

a launching apparatus coupled with the first forward panel;

a target comprising a flag, said target set above a receptacle, said target coupled to the shelter via a rotating rod having a longitudinal axis, said rotating rod set through the receptacle wherein the target and receptacle are fixedly connected to one another to allow simultaneous rotation of said target and said receptacle about the longitudinal axis;

wherein said receptacle placed above a participant location behind said forward section.

2. The apparatus as set forth in claim 1 wherein said target comprises a flat panel, and whereby said target is fixedly coupled with said receptacle via at least one flag holder fixedly coupled to said receptacle.

3. The apparatus as set forth in claim 2 wherein said target flat panel may be adjustable via a left and a right flag holder, said left and right flag holders slidably coupled to said rotating rod to set a width of said target via a distance between the left and right flag holders.

4. The apparatus as set forth in claim 1 wherein said first forward panel is angled with a top section set back and over the participant location at approximately twenty to sixty degrees from a vertical.

5. The apparatus as set forth in claim 4 further comprising a front wall extending below said first forward panel, said front wall parallel with the vertical.

6. The apparatus as set forth in claim 5 further comprising a side wall coupled to the front wall via hinges having vertical axes, and a back wall hingedly coupled to said side wall.

7. The apparatus as set forth in claim 1 wherein the launching apparatus comprises a launcher coupled to said first forward panel, said launcher comprising a centered platform set between a pair of elastic cords, each of said elastic cords comprising an end coupled to said first forward panel on opposing side of said at least one aperture.

8. The apparatus as set forth in claim 7, wherein said pair of elastic cords are coupled to a hinged protective panel covering the at least one aperture, such that pulling back the launcher retracts the hinged protective panel to expose the at least one aperture.

9. The apparatus as set forth in claim 1 wherein said first forward panel further comprises a hinged protective panel sized to cover and obstruct said at least one aperture when in a closed position, and to allow passage of a projectile from within the shelter to outside the shelter when in an open position.

10. A water launching and sheltering gaming apparatus wherein players alternatively or concurrently launch water containing projectiles towards one another's shelter targets with a goal of filling a receptacle over an opposing player with spilled water from the projectiles to cause the receptacle to lose balance and overturn contents on to the opposing player, said apparatus comprising:

a first structure comprising a first forward panel positioned between a first player and a second player, said first forward panel comprising a first reclosable aperture providing a first shield, a second structure comprising a second forward panel comprising at least one aperture; said second forward panel comprising a second reclosable aperture providing a second shield; said first and second structures facing one another;

a first target fixedly coupled to a first receptacle, said first target and first receptacle rotatably coupled to said first structure, positioned above a first position behind the first forward panel; and a second target coupled to a second receptacle rotatably coupled to said second structure, positioned above a second position behind the second forward panel;

wherein the first receptacle comprises weights to counterbalance the first receptacle and bias the first receptacle to deter rotation;

a first launching apparatus mounted to a first frame of the first forward panel; and a second launching apparatus mounted to a second frame of the second forward panel;

wherein the first forward panel is coupled to the first shield to allow for independent manipulation of the first shield to an open and closed position; and wherein the second forward panel is coupled to the second shield to allow for independent manipulation of the second shield to an open and closed position; said second shield in closed position obstructing a direct path from the first reclosable aperture.

11. The apparatus of claim 10 wherein:

the first receptacle is positioned under the first target and above the first position; and the second receptacle is positioned under the second target and above the second position.

12. The apparatus of claim 11 wherein the first receptacle is rotatably mounted to a first bar, said first bar forming a first rotation axis set on a back section of said first receptacle offsetting the first receptacle's center of gravity, said first receptacle adapted to invert when a predetermined weight of fluid is deposited in said first receptacle; and wherein the second receptacle is rotatably mounted to a second bar, said second bar forming a second rotation axis.

13. The apparatus of claim 10 wherein the first target is adjustable in shape and position, and said second target is independently adjustable in shape and position.

14. The apparatus of claim 10 wherein said first target and said second target each comprise a stiff planar body.

15. The apparatus of claim 10 wherein said first target is fixedly mounted to said first receptacle such that rotation and inversion of said first receptacle pulls and rotates the target to a down position.

16. A method of preparing and playing a competitive water balloon launching game, wherein the competitors are positioned behind shielding structures, to allow for alternative launching of projectiles at a target positioned above the opposing player, said method comprising the steps of positioning a first player behind a first forward panel, coupling a first launching apparatus to the first forward panel via a first elastic cord, and coupling the first launching apparatus to a first window in the first forward panel via a first lifting cord;

further positioning a second player behind a second forward panel such that the first and second forward panels are situated between the first and second players;

further coupling a second launching apparatus to the second forward panel with a second window;

pulling back the first launching apparatus to mechanically lift the first window into an open position via the first lifting cord while simultaneously providing the first elastic cord with potential energy;

launching a first projectile with the first launching apparatus through the first window towards a second target positioned above a second receptacle, the second receptacle rotatably connected to a second structure via a lateral bar;

filling the second receptacle with fluid from the launched first projectile to modify the center of gravity of the second receptacle forward; and dumping fluid contents from the second receptacle onto a second player position when the center of gravity of the second receptacle with deposited fluids set therein adjusts the center of gravity of the second receptacle forward of the lateral bar.

17. The method as set forth in claim 16 whereby said first window is closed after said step of launching via a handgrip coupled to the first lifting cord.

18. The method as set forth in claim 17 further comprising the step of reopening the first window via pulling the handgrip.

19. The method as set forth in claim 16 whereby said step of dumping comprises the step of dropping the second target to indicate a dumping event.

20. The method as set forth in claim 16 whereby said filling causes fluid to fill a volume on one side of the second receptacle causing an unbalancing of the second receptacle about an axis of rotation.

* * * * *